US006557984B2

(12) United States Patent
Tanaka et al.

(10) Patent No.: US 6,557,984 B2
(45) **Date of Patent: *May 6, 2003**

(54) INK-JET PRINTING HEAD AND INK-JET PRINTING APPARATUS

(75) Inventors: Sohei Tanaka, Kawasaki (JP); Shinji Takagi, Kawasaki (JP); Takeshi Ono, Yokohama (JP); Masafumi Wataya, Kawasaki (JP); Noriyuki Suzuki, Tokyo (JP); Masaaki Okada, Fukushima (JP); Hiroyuki Hyotani, Kawasaki (JP); Midori Yasuda, Yokohama (JP); Akira Ito, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 73 days.

(21) Appl. No.: 09/428,449

(22) Filed: Oct. 28, 1999

(65) Prior Publication Data

US 2002/0163562 A1 Nov. 7, 2002

(30) Foreign Application Priority Data

| | | |
|---|---|---|
| Oct. 30, 1998 | (JP) | 10-310349 |
| Oct. 30, 1998 | (JP) | 10-310350 |
| Dec. 21, 1998 | (JP) | 10-363272 |
| Dec. 21, 1998 | (JP) | 10-363273 |
| Dec. 21, 1998 | (JP) | 10-363274 |
| Dec. 21, 1998 | (JP) | 10-363275 |
| Jan. 13, 1999 | (JP) | 11-006722 |
| Oct. 18, 1999 | (JP) | 11-296010 |

(51) Int. Cl.[7] ..... B41J 2/05; B41J 2/015
(52) U.S. Cl. ..... 347/65; 347/21
(58) Field of Search ..... 347/43, 65, 21, 347/22, 28; 356/425, 402

(56) References Cited

U.S. PATENT DOCUMENTS

| | | | | |
|---|---|---|---|---|
| 4,313,124 A | | 1/1982 | Hara | 346/140 |
| 4,345,262 A | | 8/1982 | Shirato et al. | 346/140 |
| 4,459,600 A | | 7/1984 | Sato et al. | 346/140 |
| 4,463,359 A | | 7/1984 | Ayata et al. | 346/1.1 |
| 4,558,333 A | | 12/1985 | Sugitani et al. | 346/140 |
| 4,614,953 A | | 9/1986 | Lapeyre | 346/140 |
| 4,723,129 A | | 2/1988 | Endo et al. | 346/1.1 |
| 4,740,796 A | | 4/1988 | Endo et al. | 346/1.1 |
| 5,371,529 A | | 12/1994 | Eguchi et al. | 347/7 |
| 5,646,656 A | * | 7/1997 | Leonhardt et al. | 347/43 |
| 5,764,252 A | | 6/1998 | Burr et al. | 347/20 |
| 6,052,195 A | * | 4/2000 | Mestha et al. | 356/425 |
| 6,416,157 B1 | * | 7/2002 | Peeters et al. | 347/21 |

FOREIGN PATENT DOCUMENTS

| | | |
|---|---|---|
| EP | 0 655 337 | 5/1995 |
| EP | 0 816 088 | 1/1998 |
| EP | 0 819 535 | 1/1998 |
| JP | 59-123670 | 7/1984 |
| JP | 59-138461 | 8/1984 |
| JP | 5-201024 | 8/1993 |

OTHER PUBLICATIONS

Patent Abstracts of Japan, vol. 007, No. 120 (M–217), (JP 58–038189, Mar. 5, 1983).

Patent Abstracts of Japan, vol. 015, No. 481 (M–1187), (JP 03–207664, Sep. 10, 1991).

* cited by examiner

*Primary Examiner*—Thinh Nguyen
(74) *Attorney, Agent, or Firm*—Fitzpatrick, Cella, Harper & Scinto

(57) ABSTRACT

An ink-jet printing head and an ink-jet printing apparatus can reduce fluctuation of density of an ink ejected from each nozzle by ejecting ink of different densities from the same nozzle without varying size of an ink droplet, or by controlling ejection of a mixture ink, in which a plurality of inks are mixed, for forming an image. The ink-jet printing head includes a plurality of ejection openings for ejecting ink, a plurality of ink passages communicated with the plurality of ejection openings, ink ejecting energy generating elements provided in the plurality of ink passages, a mixing liquid chamber connected to the plurality of ink passages in common, a plurality of individual liquid chambers supplying ink to the mixing liquid chamber, and a valve mechanism provided between the individual liquid chamber and the mixing liquid chamber and controlling supply amount of the inks supplied from the individual liquid chambers.

3 Claims, 21 Drawing Sheets

INK-JET PRINTING HEAD AND INK-JET PRINTING APPARATUS

This application is based on Japanese Patent Application Nos. 10-310349 filed on Oct. 30, 1999, 10-310350 filed on Oct. 30, 1998, 10-363272 filed on Dec. 21, 1998, 10-363273 filed on Dec. 21, 1998, 10-363274 filed on Dec. 21, 1998, 10-363275 filed on Dec. 21, 1998, 11-006722 filed on Jan. 13, 1999, 11-296010 filed on Oct. 18, 1999, the content of which is incorporated hereinto by reference.

BACKGROUND OF THE INVENTION

1. Field of the Invention

The present invention relates to an on-demand type ink-jet printing apparatus, and an ink-jet printing head which can be equipped in the ink-jet printing apparatus.

2. Description of the Related Art

In general, an ink-jet printing apparatus can be generally classified into a continuous ejection type (hereinafter also referred to as continuous type) and an on-demand type. The former continuous type ink-jet printing apparatus continuously ejects ink droplets from a fine nozzle at a predetermined period, and deposits the ink droplets at predetermined positions on printing paper as a printing medium, by subsequently applying an electric charge on the ink droplets for causing deflection toward the predetermined positions. Advantages of such continuous type ink-jet printing apparatus are high frequency response, capability of making the ink-droplet more fine, capability of high speed printing despite of single nozzle, and capability of performing printing of an image with high resolution. On the other hand, since such continuous type ink-jet printing apparatus requires a mechanism for collecting inks, overall construction becomes bulky and thus is not well suited for multiple nozzle construction.

In contrast to this, in the case of the former on-demand type ink-jet printing apparatus, ink can be deposited at predetermined positions on the printing paper as a printing medium by controlling ink ejection from nozzles corresponding to the position to perform image printing in a system ejecting an ink using a pressure by deformation of a piezoelectric element provided in a plurality of fine nozzles or a pressure generated by volume expansion of a bubble generated by heating of the ink for causing film boiling by a heating element. The ink-jet printing apparatus of this type is advantageous in easiness for adaptation to multiple nozzle construction for simple construction and in realization of compact and inexpensive image printing apparatus. On the other hand, since the ink does not always flow through the nozzle, plugging of the nozzle due to drying of the ink, variation of quality of the ink, penetration of dust and so on can be caused. Therefore, a recovery mechanism for solving the problem of plugging becomes inherent.

On the other hand, in the foregoing two types of ink-jet printing apparatus, a common problem is encountered in difficulty of density modulation of the ink droplet. Therefore, expression of more precise gradation in an intermediate tone can be realized only by a system controlling size of the ink droplets among a plurality of steps of sizes of the ink droplets, and by a system performing ejection from different nozzles with a plurality of mutually different densities of inks.

The highest quality of more precise gradation expression is achieved by a system performing printing with varying density of the ink droplets without varying size of the ink droplet.

Such system in the continuous type ink-jet printing apparatus has been proposed in U.S. Pat. No. 4,614,953. On the other hand, such system in the on-demand type ink-jet printing apparatus has been proposed in Japanese Patent Application Laid-open No. 5-201024 (1993) (U.S. Pat. No. 5,371,529).

However, in U.S. Pat. No. 4,614,953 directed to the continuous type ink-jet printing apparatus, difficulty in employing a plurality of nozzles as drawback of the continuous type is not mentioned. Therefore, the continuous type is not applicable for compact and inexpensive printing apparatus.

On the other hand, in Japanese Patent Application Laid-open No. 5-201024 (1993) (U.S. Pat. No. 5,371,529) directed to the on-demand type ink-jet printing apparatus, a mechanism for mixing the inks per the ejection nozzle is disclosed. However, due to the presence of such mixing mechanism, down-sizing can be hindered upon employing the multiple nozzle construction. Furthermore, fluctuation of the ink density between the nozzles can be caused easily.

SUMMARY OF THE INVENTION

The present invention has been worked out for solving the problems set forth above. It is a first object of the present invention to provide an ink-jet printing head and an ink-jet printing apparatus which can reduce fluctuation of density of an ink ejected from each nozzle by ejecting ink of different densities from the same nozzle without varying size of an ink droplet, or by controlling ejection of a mixture ink, in which a plurality of inks are mixed, for forming an image.

A second object of the present invention is to provide an ink-jet printing head and an ink-jet printing apparatus which can minimize consumption of ink.

A third object of the present invention is to provide various modes of implementation associated with the ink-jet printing head and the ink-jet printing apparatus according to the present invention.

To achieve the first object of the present invention, there is provided an ink-jet printing head comprising:

- a plurality of ejection openings for ejecting ink;
- a plurality of ink passages respectively communicated with the plurality of ejection openings;
- means provided in the plurality of ink passages for ejecting ink;
- a mixing liquid chamber connected to the plurality of ink passages in common;
- a plurality of individual liquid chambers supplying ink to the mixing liquid chamber; and
- a valve mechanism, provided between each the individual liquid chamber and the mixing liquid chamber, for controlling a supply amount of the ink supplied from the individual liquid chamber.

With the printing head constructed as set forth above, by providing one mixing liquid chamber communicated with a plurality of ejection openings and a plurality of ink supply passages and by providing control means for controlling ink supply amount to the mixing liquid chamber, it becomes possible to vary the density with maintaining the size of the ink droplet constant to realize printing with higher printing quality. On the other hand, by adjusting the ink density in the mixing liquid chamber, the ink with different densities can be ejected without using a plurality of printing heads and preliminarily prepared inks with different densities. For example, a colored ink is filled in one of two individual liquid chambers communicated with the mixing liquid chamber, and an achromatic ink is filled in the other individual chamber to obtain an ink of the density of half of the colored ink by mixing the colored ink and the achromatic ink within the mixing liquid chamber in a proportion of 1:1. Furthermore, it is possible to fill the ink of cyan color in one of the individual liquid chambers and to fill the ink of yellow color in the other individual liquid chamber to obtain the ink of green color by mixing both inks in a proportion of 1:1 within the mixing liquid chamber.

Here, the ink-jet printing head as claimed in claim 1, which further may comprise ink moving means for moving the ink by applying energy to the ink sufficient for moving the ink from the individual liquid chamber to the mixing liquid chamber.

The plurality of individual liquid chambers may contain inks having mutually different compositions respectively.

A washing liquid which is supplied for discharging liquid in the mixing liquid chamber, may be stored in one of the plurality of individual liquid chambers.

A plurality of the valve mechanisms may be provided for each of the individual liquid chambers.

The plurality of valve mechanisms may be provided corresponding to ink passages having different open areas between the individual liquid chamber and the mixing liquid chamber.

The plurality of valve mechanisms may be provided corresponding to ink passages having the same open area between the individual liquid chamber and the mixing liquid chamber.

A partitioning wall serving as ink mixing means may be provided in the mixing liquid chamber for promoting mixing of the inks.

A discharge passage for discharging a mixture ink in the mixing liquid chamber.

A plurality of ejection openings may be arranged in a row and the discharge passage may be communicated with a discharge opening arranged on an extension in a row direction of the ejection openings.

The discharge passage may be arranged in a direction intersecting with a supply direction of the ink from the individual liquid chamber to the mixing liquid chamber.

To achieve the second object of the present invention, there is provided an ink-jet printing head comprising:

- a plurality of ejection openings for ejecting ink;
- a plurality of ink passages respectively communicated with the plurality of ejection openings;
- ink ejection means provided in the plurality of ink passages for ejecting ink;
- an ejection liquid chamber connected to the plurality of ink passages in common;
- at least one mixing liquid chamber connected to the ejection liquid chamber;
- a plurality of individual liquid chambers supplying ink to the mixing liquid chamber; and
- first path control means, provided between the individual liquid chambers and the mixing liquid chamber, for controlling a supply amount of the inks supplied from the individual liquid chambers.

With the construction set forth above, by providing the intermediate liquid chamber for storing the mixture ink between the mixing liquid chamber and the ejection liquid chamber, an ink consuming amount upon switching of inks can be restricted to only an ink amount in the ejection liquid chamber to lower the ink consuming amount associating with switching of the ink and to shorten the switching period. On the other hand, by providing a plurality of intermediate liquid chambers to establish a plurality of passages from the mixing liquid chamber to the ejection liquid chamber to perform switching of the ink with selecting the passage. After switching, with performing mixing operation again, the ink having the same mixture ratio can be ejected.

Here, the ink-jet printing head as claimed in claim 12, which further may comprise an intermediate liquid chamber arranged between the mixing liquid chamber and the ejection liquid chamber.

A plurality of the intermediate liquid chambers may provided.

On the other hand, the present invention provides various associated aspects having particular effect in addition to the first object or independently.

According to another aspect of the present invention, here is provided an ink-jet printing head comprising:

- a plurality of ejection openings arranged in a row and for ejecting ink;
- a plurality of ink passages communicated with the plurality of ejection openings respectively;
- ink ejecting means provided in the plurality of ink passages for ejecting ink;
- a common liquid chamber connected to the plurality of ink passages in common;
- an ink supply portion for supplying ink to the common liquid chamber;
- control means, provided between the ink supply portion and the common liquid chamber, for controlling a supply amount of ink supplied from the ink supply portion; and
- an atmosphere communication opening, arranged on an extension of the row of the ink ejection openings, for communicating the common liquid chamber with atmosphere.

With the construction set forth above, by using the atmosphere communication opening as an atmospheric air suction opening into the head, cleaning of the common liquid chamber and cleaning operation of the printing nozzle can be facilitated and assured. Also, by using the atmosphere communication opening as an ink suction opening, quicker ink suction operation than that in the case where ink suction is performed only through the normal printing nozzles, can be realized. Furthermore, by using one atmosphere communication opening for two ways as an atmosphere suction opening and an ink discharge opening, the foregoing superior effect can be achieved with simple construction of the printing head.

According to yet another aspect of the present invention, there is provided a liquid-jet printing head comprising:

- a plurality of ejection openings for ejecting liquid;
- a plurality of liquid passages communicated with the plurality of ejection openings;
- a first liquid chamber connected to the plurality of liquid passages in common;
- a liquid supply portion supplying the liquid to the first liquid chamber; and
- a second liquid chamber storing a washing liquid to be supplied for discharging the liquid in the first liquid chamber.

With the construction set forth above, a liquid ejecting apparatus and a liquid ejection head which are compact and inexpensive and can reproduce more precise gradation by exchanging only ink tanks without exchanging the printing head. Also, it becomes possible to provide the liquid ejecting apparatus and the liquid ejection head which can quickly and certainly switch the ink in the liquid chamber in the printing head without causing admixing of the colors in simple construction.

To achieve also the first object of the present invention, there is provided an ink-jet printing apparatus performing printing on a printing medium by ejecting ink thereon, comprising:

an ink-jet printing head having an ink chamber storing the ink to be ejected and a plurality of ink supply passages capable of supplying mutually different kinds of inks to the ink chamber;

ink supply means capable of supplying a plurality of kinds of inks which have the same composition and different density, to the plurality of ink supply passages respectively; and selecting means for selecting kind of the ink to be supplied into the ink chamber from the plurality of ink supply passages on the basis of an image data.

Here, the selecting means may select one of the plurality of ink supply passages for supplying the ink having a density corresponding to a density level of the image data into the ink chamber from the selected ink supply passage.

According to yet another aspect of the present invention, there is provided an ink-jet printing apparatus performing printing on a printing medium by ejecting ink thereon, comprising:

an ink-jet printing head having an ink chamber storing the ink to be ejected and a plurality of ink supply passages capable of supplying mutually different kinds of inks to the ink chamber;

ink supply means for supplying a first ink having a predetermined density to at least one of the plurality of ink supply passages and a second ink reducing density of the first ink without varying composition thereof, to at least another one of the plurality of ink supply passages; and selecting means for selecting kind of the ink to be supplied into the ink chamber from the plurality of ink supply passages on the basis of an image data.

With the construction set forth above, it becomes possible to provide an ink-jet printing apparatus and an ink-jet printing method to realize recording, such as printing, with more precise gradation using the ink-jet printing head which can eject inks of different ink density from the same nozzle without varying the size of the ink droplet with maintaining advantages of the on-demand type ink-jet printing system.

Here, the selection means may select more than or equal to two of the plurality of ink supply passages for mixing the first ink and the second ink from the selected ink supply passages in the ink chamber for preparing an ink of a density corresponding to a density level of the image data.

The ink-jet printing apparatus as claimed in claim 19, which further may comprise a control means for making overlapping print an image on the printing medium for more than or equal to two times when the selection means supplies an ink having density lower than the density level of the image data to the ink chamber.

The selection means may vary kind of the ink to be supplied to the ink chamber for more than or equal top one time when the image is printed in overlapping manner for more than or equal to two times by the control means.

To achieve also the second object of the present invention, there is provided an ink- jet printing apparatus for performing printing on a printing medium by ejecting ink, comprising:

a printing portion having ejection opening s for ejecting the ink and an ink mixing chamber for mixing the ink to be ejected;

a target density setting portion for setting an ink density having relatively high use frequency as a target ink density on the basis of an image data representative of an image to be printed by the printing portion;

a mixture ratio calculating portion for calculating a mixture ratio of a residual ink in the ink mixing chamber of the printing portion and an ink of predetermined density supplied to the ink mixing chamber so that the ink density of the ink mixing chamber of the printing portion becomes the target ink density on the basis of the target ink density data set by the target density setting portion;

an ink density adjustment control portion for adjusting and controlling the ink density in the ink mixing chamber prepared by mixing the residual ink in the ink mixing chamber of the printing portion and the ink from an ink supply portion supplying a predetermined amount of the ink having predetermined density to the ink mixing chamber, for establishing the target ink density on the basis of the data representative of the mixture ratio from the mixture ratio calculating portion; and a printing operation control portion for making the printing portion to perform printing operation on the basis of the image data.

Here, the ink density adjustment control portion may comprise:

a discharge operation control portion for making an ink discharge means to perform discharge operation for discharging a predetermined amount of the residual ink in the ink mixing chamber on the basis of data representative of the mixture ratio from the mixture ratio calculating portion; and a supply operation control portion for making an ink supply means to perform ink supply operation for supplying a predetermined amount of the ink with the predetermined density to the ink mixing chamber on the basis of the data representative of the mixture ratio from the mixture ratio calculating portion.

The ink supply means may comprise:

a plurality of ink chambers respectively storing inks having mutually different ink densities;

control valves, provided in liquid passages for introducing the inks from the plurality of ink chambers to the ink mixing chamber, for selectively adjusting an ink supply amount introduced into the ink mixing chamber; and energy generating element s arranged adjacent the control valves and causing the ink to flow from the ink chambers through the control valve s.

The target density setting portion may vary the target ink density on the basis of the image data per one scan of the printing portion for a printing surface of the printing medium.

The printing operation control portion for making the printing portion to perform printing operation on the basis of the image data may make to perform printing operation from a portion to be printed with relatively high ink density to a portion to be printed with relatively low ink density in the image to be formed on the printing surface of the printing medium.

The supply operation control means, which may make the ink supply means to perform ink supply operation on the basis of the data representative of the mixture ratio from the mixture ratio calculating portion, may make the ink supply means to perform ink supply operation such that a supply amount is proportional to an ink ejection amount of the printing portion during printing operation of the printing portion.

According to yet another aspect of the present invention, there is provided an ink-jet printing apparatus comprising;

an ink-jet printing head including:

a plurality of ejection openings arranged in a row and ejecting ink;

a plurality of ink passages respectively communicated with the plurality of ejection openings;

an ink ejection means provided in the plurality of ink passages;

a common liquid chamber connected to the plurality of ink passages in common;

an ink supply portion for supplying the ink to the common liquid chamber;

control means, provided between the ink supply portion and the common liquid chamber, for controlling an supply amount of the ink supplied from the ink supply portion;

an atmosphere communication opening, arranged on an extension of the row of the ink ejection openings, for communicating the common liquid chamber with outside;

first capping means for placing the ink eject ion openings of the printing head within an sealingly enclosed space;

first suction means for reducing a pressure within the enclosed space between the first capping means and the printing head;

second capping means for placing the atmosphere communication opening of the printing head within a sealingly enclosed space;

second suction means for reducing a pressure within the enclosed space between the second capping means and the printing head; and wherein the first suction means and the second suction means are driven at respectively independent timing.

Here, the ink-jet printing apparatus as claimed in claim 29, which may further comprise a carriage for moving the printing head for scanning, and a waste ink absorbing body extending along a scanning direction of the printing head at a position overlapping with a range in which printing by the printing head on the printing medium can be performed, for receiving a waste ink discharged from the printing head.

The printing head may discharge the waste ink toward the waste ink absorbing body during movement.

The above and other objects, effects, features and advantages of the present invention will become more apparent from the following description of embodiments thereof taken in conjunction with the accompanying drawings.

BRIEF DESCRIPTION OF THE DRAWINGS

FIGS. 2A and 2B are general sections for explaining operation of a control valve shown in FIG. 1, wherein FIG. 2A shows a state where a voltage is not applied, and FIG. 2B shows a state where a voltage is applied;

FIGS. 4A and 4B are enlarged illustrations of the major parts in the printing apparatus shown in FIG. 3, wherein FIG. 4A is an enlarged perspective view of a cap member, and FIG. 4B is an enlarged section showing a construction of a suction pump;

DETAILED DESCRIPTION OF THE PREFERRED EMBODIMENT

Embodiments of the present invention will be explained with reference to the accompanying drawings.

(First Embodiment)

Figure 1:
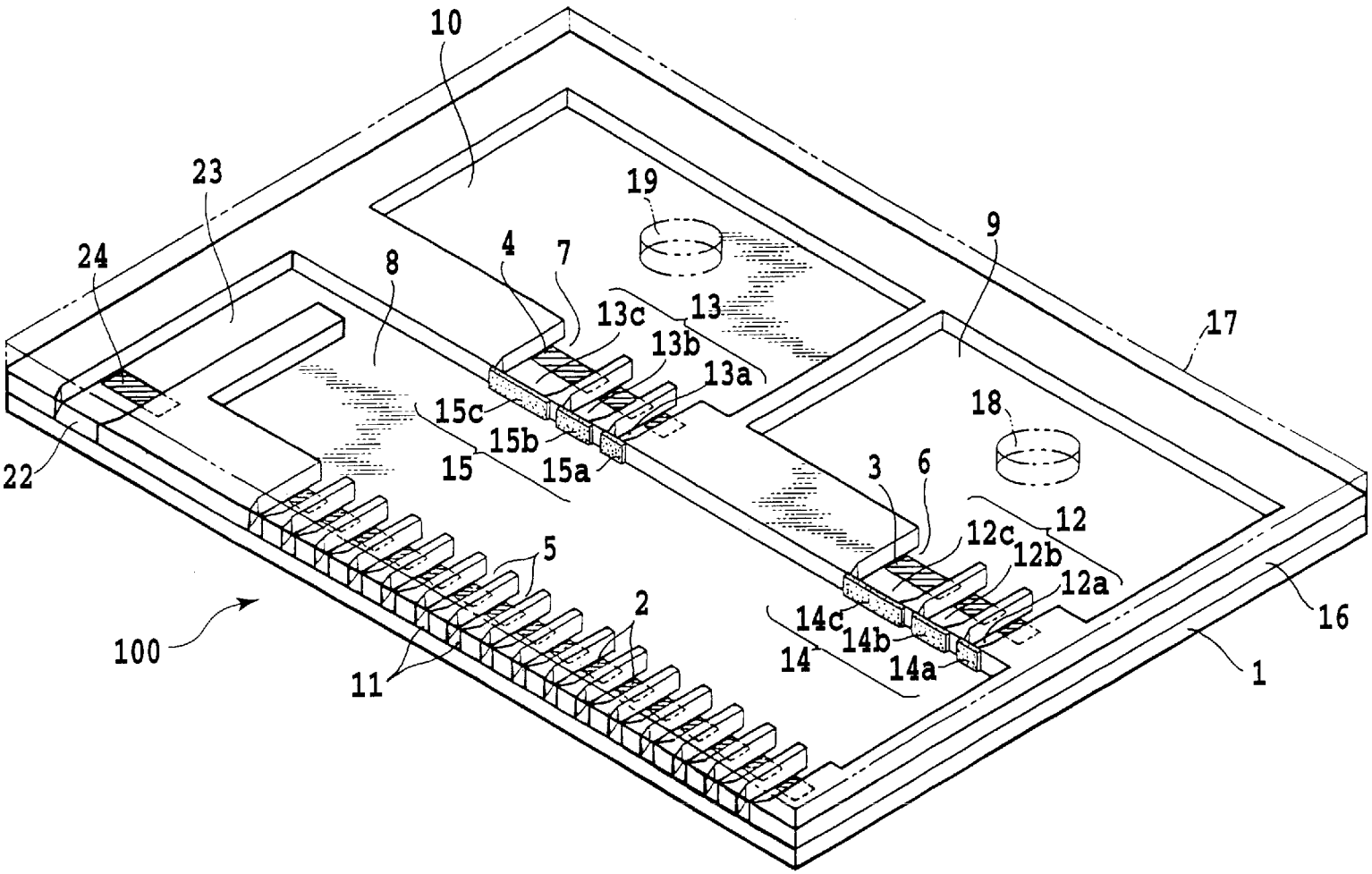
FIG. 1 is an exploded perspective view of the major part of the first embodiment of an ink-jet printing head according to the present invention, which is shown in enlarged fashion.

FIG. 1 is an exploded perspective view of the major part of an ink-jet printing head (hereinafter also referred to as "printing head") according to the present invention.

In FIG. 1, Reference numeral 1 denotes a substrate formed of glass, ceramic, metal or the like, for example. At a predetermined position on the substrate 1, a plurality of thermal energy generating elements 2 are provided as ink ejection means. At the rear positions of the thermal energy generating elements 2, a plurality of energy generating elements 3 and 4 serving as ink moving means are provided. In the shown embodiment, the energy generating element may be an electromechanical transducer or the like, such as piezoelectric element, piezo element or the like, in addition to an electrothermal transducer. It should be noted that while the electrothermal transducer is used as the energy generating elements 3 and 4 similarly to the foregoing thermal energy generating element 2 in the shown embodiment, for example, the energy generating elements 3 and 4 may be piezoelectric elements.

The thermal energy generating elements 2 are arranged on one peripheral edge of the substrate 1 with a regular interval. These thermal energy generating elements are separated with each other by wall portions of ink passages 5, respectively. A front end of each ink passage 5 is communicated with an ejection opening 11 for ejecting ink. A rear end of each ink passage 5 is communicated with a mixing liquid chamber 8.

On the rear side of the mixing liquid chamber 8, two individual liquid chambers 9 and 10 are provided. The mixing liquid chamber 8 is communicated with the individual liquid chamber 9 via a communication opening 12 and with the individual liquid chamber 10 via a communication opening 13. The communication opening 12 in the shown embodiment is formed with three opening portions 12*a*, 12*b* and 12*c* respectively having different opening areas. Similarly, the communication opening 13 in the shown embodiment is formed with three opening portions 13*a*, 13*b* and 13*c* respectively having different opening areas. With taking the sizes of the areas of the opening portions 12*a* and 13*a* having the minimum opening areas, the opening areas of the opening portions 12*b* (13*b*) are set at double and the opening areas of the opening portions 12*c* (13*c*) are set at four times.

In the opening portions 12*a*, 12*b* and 12*c*, control valves 14*a*, 14*b* and 14*c* which have mutually different sizes respectively corresponding to the opening areas of the corresponding opening portions and can be opened and closed as required, are mounted. The control valves 14*a*, 14*b* and 14*c* will also be identified by Reference numeral 14 as generally referred to. Similarly, in the opening portions 13*a*, 13*b* and 13*c*, control valves 15*a*, 15*b* and 15*c* which have sizes respectively corresponding to the opening areas of the corresponding opening portions and can be opened and closed as required, are mounted. The control valves 15*a*, 15*b* and 15*c* will also be identified by Reference numeral 15 as generally referred to. These control valves serve for preventing the inks in the individual liquid chambers from flowing into the mixing liquid chamber, and in conjunction therewith, serve for preventing the ink in the mixing liquid chamber 8 from flowing back to the individual liquid chambers.

On the other hand, in each opening portion, a liquid passage 6 or 7 is connected for communication therewith. In the bottom portion of each liquid passage 6 or 7, the energy generating element 3 or 4 is arranged. It should be noted that an electrode (not shown) is connected to each of these energy generating elements in order to input a drive signal.

The printing head constructed as set forth above can be fabricated by laminating a filler member 16 forming wall portions of the ink passages 5 and respective liquid chambers 8, 9 and 10 on the substrate 1 set forth above, and by further laminating a constructional member 17 formed with ink supply openings 18 and 19 thereon.

Figure 2A:
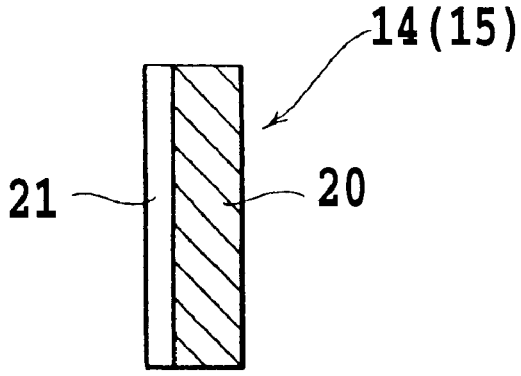
Figure 2B:
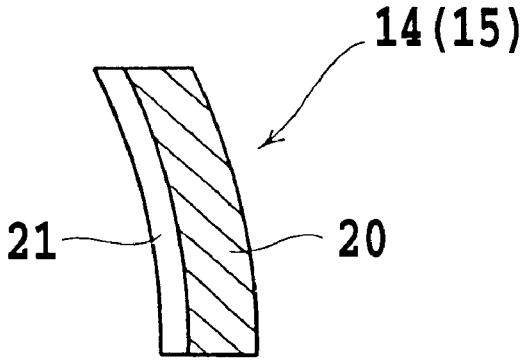

Next, construction of the control valve 14(15) set forth above will be explained with reference to FIGS. 2A and 2B.

The control valve 14(15) is generally constructed with a plate form thin film piezoelectric body 20 and a metallic thin film electrode 21 fitted on one surface of the piezoelectric body 20, for example. Before applying a voltage, the control valve 14(15) is maintained in flat shape as shown in FIG. 2A. When a voltage is applied, a thickness of the piezoelectric body 20 is varied to cause deflection of the control valve 14(15) per se, as shown in FIG. 2B. Using this variation of the shape, the communication opening 12(13) can be controlled to be opened and closed independently of each other. These control valves 14(15) perform opening and closing operation in synchronism with driving of the energy generating elements 3(4) serving as an ink moving means arranged within respectively corresponding communication openings 12(13). At this time, in consideration of the fact that an ink pressure within the mixing liquid chamber 8 is maintained constant, it is desirable that the ink moving means is driven in synchronism with driving of the ink ejecting means, and number of pulses of drive control pulse signal of the energy generating elements 3 and 4 are controlled in proportion to number of pulses of driven control pulse signal to be applied to the ejection energy generating elements 2 to make the amount of ink transferred through the communication openings 12(13) equal to the ejection amount from the ejection openings 11. By such control for maintaining the ink pressure within the mixing liquid chamber 8 constant, a precision of ink mixing ratio can be improved.

In the foregoing printing head, an ejection opening 22 are provided separately from a row of the ejection openings 11 set forth above. The ejection opening 22 can discharge liquid, such as ink or the like within the mixing liquid chamber 8 using thermal energy generated by a thermal energy generating element 24 arranged in a bottom portion in an ink passage 23. Namely, the ejection opening 22, the liquid passage 23 and the thermal energy generating element 24 form a discharging means. The discharging means becomes active upon varying mixing ratio of the inks in the mixing liquid chamber 8 or upon cleaning the mixing liquid chamber 8 and the ink passage 5 in order to serve as an atmosphere communication opening (air hole) for permitting temporarily emptying the mixing liquid chamber 8. A recovery operation therefor will be explained later with reference to FIG. 4. The thermal energy generating element 24 can be used for positively discharging an extra ink within the mixing liquid chamber instead of sucking such an extra ink by means of a suction pump of a recovery device.

Figure 3:
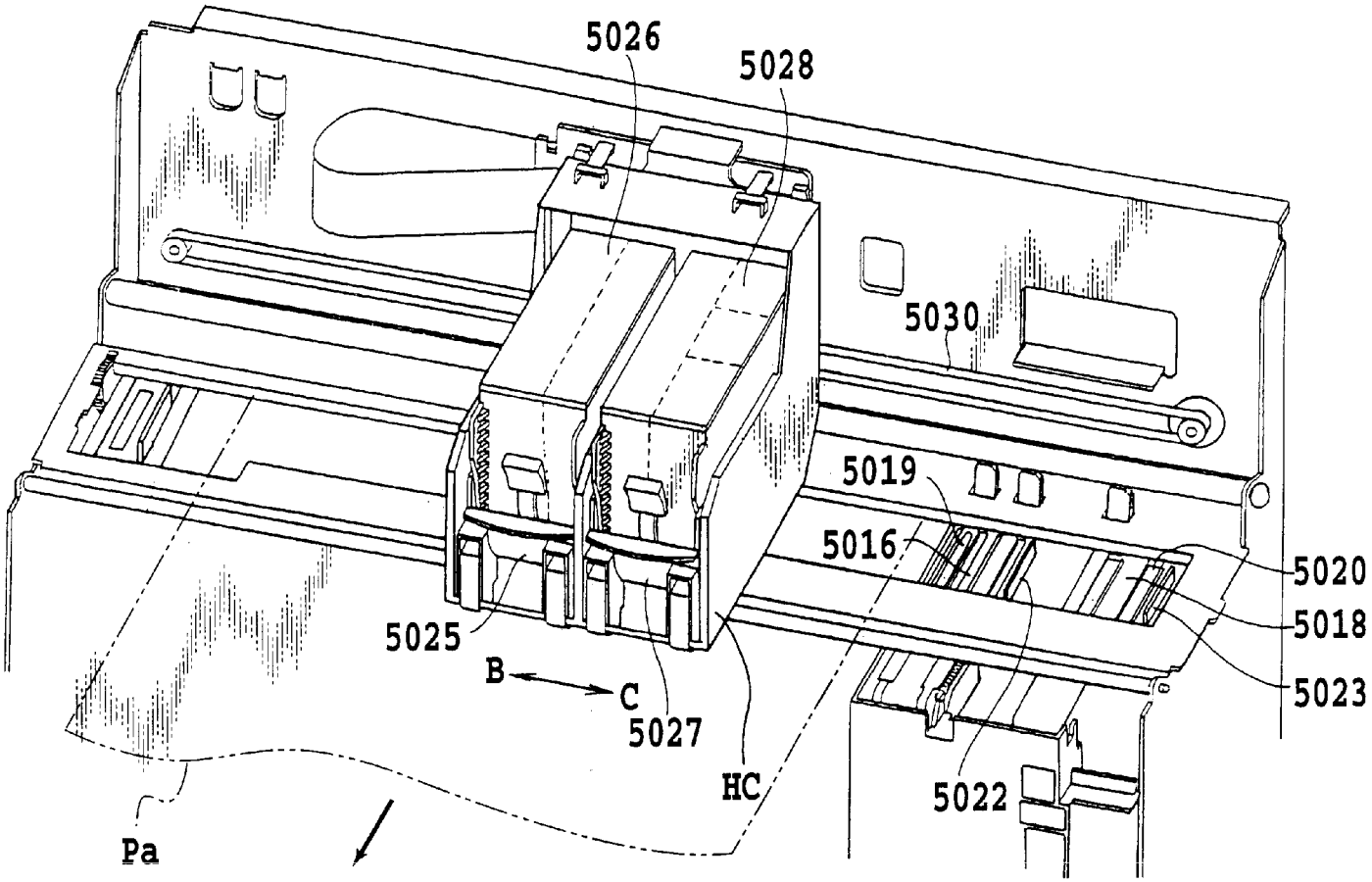
FIG. 3 is a perspective view shown one example of an ink-jet printing apparatus, in which the printing head having a construction shown in FIG. 1, is applicable.

FIG. 3 is an exploded perspective view showing one example of an ink-jet printing apparatus, to which the printing head constructed as set forth above is applicable. In FIG. 3, the reference sign HC denotes a carriage which can detachably mount the printing head and tank portions for supplying inks thereto. The carriage HC is moved reciprocally in the directions shown by arrows B and C in cooperation with forward and reverse operation of a drive motor (not shown) and a timing belt 5030 which is, in turn, associated with the drive motor. On the carriage HC, a one chip printing head portion 5025 for a black (K) ink, a tank portion 5026 for the K ink and an achromatic ink, which can be detachably set on the printing head portion 5025, a color printing head 5027 of a one chip triple color (yellow (Y) ink, magenta (M) ink and cyan (C) ink), and an ink tank portion

5028 for three colors and an achromatic ink, which can be detachably mounted on the ink head 5027.

On the other hand, in a portion D of the tank portion 5026, the K ink for printing is stored and in the portion E, the achromatic ink is stored. Also, in a portion F of the tank 5028, the Y ink is stored, in a portion G, the M ink is stored, in a portion H, the C ink is stored, and in a portion I, the achromatic ink is stored.

At one end of a motion range of the carriage HC (right end in FIG. 3), a cap member 5016 for capping an orifice surface of the head for K ink in the one chip printing head portion 5025 is arranged. On the outer side of the cap member 5016, a cap member 5018 for capping an orifice surface of the one chip triple color printing head portion 5027 is arranged. On the other hand, Reference numeral s 5019 and 5020 are means for sucking within the cap members 5016 and 5018. Reference numerals 5022 and 5023 are cleaning blades for wiping the orifice surfaces of the triple color printing head and the K ink head.

Figure 4A:
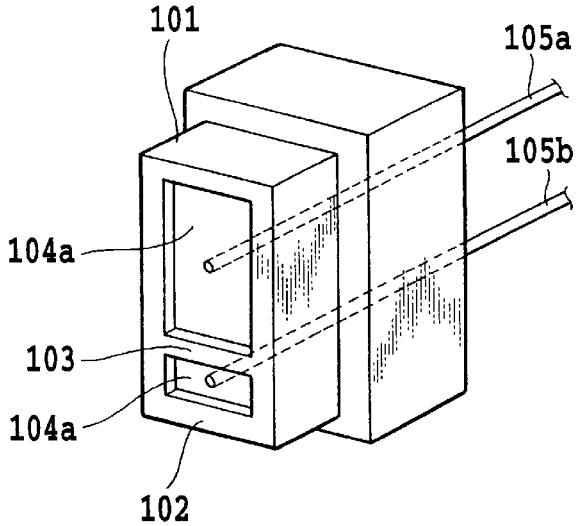

FIG. 4A is an enlarged perspective view showing a construction of the cap member set forth above. In FIG. 4A, Reference numeral 101 denotes a cap as one example of the cap member set forth above. The cap 101 is formed of an elastic member, such as rubber or the like in at least fitting portion with the printing head in order to perform pressure fitting with a surface (orifice surface) including a row of the ejection openings 11 of the printing head upon capping. On the other hand, in the cap 101, a rib 102 formed in the peripheral portion to be sealingly fitted onto the orifice surface of the printing head, and a rib 103 for shutting off the ejection openings 11 for printing and the atmosphere communication opening 22 for recovery operation. By the rib 103, the inside of the cap 101 is divided into suction spaces 104*a* and 104*b*. In the suction spaces 104*a* and 104*b*, suction tubes 105*a* and 105*b* are connected, respectively.

Next, a suction pump unit will be explained with reference to FIGS. 4B.

Figure 4B:
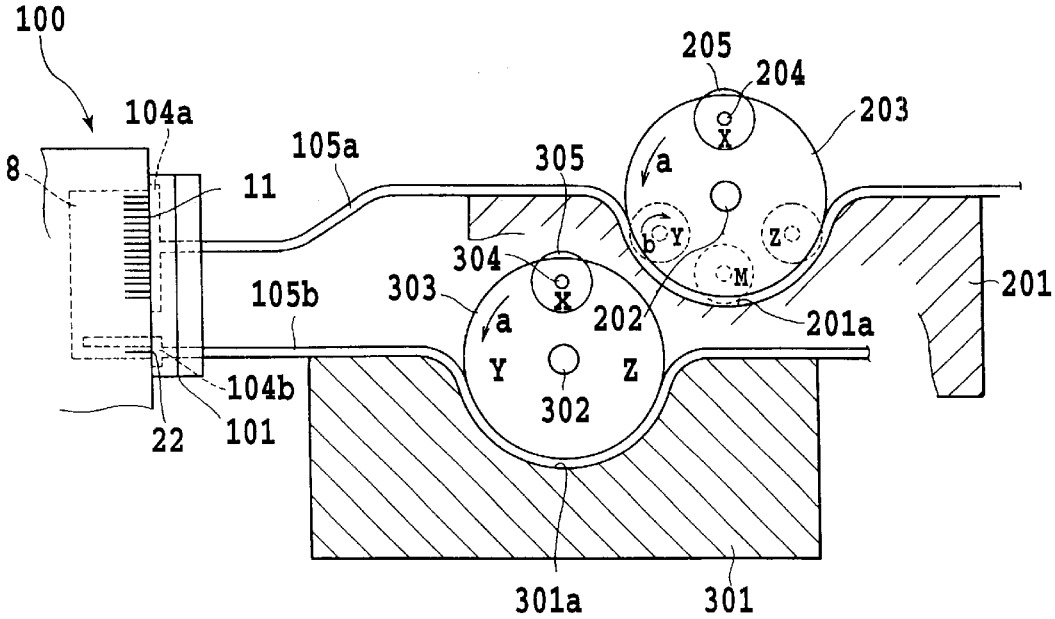

In FIG. 4B, the suction tube 105*a* communicated with the suction space 104*a* of the ink suction cap 101 is arranged in an arc-shaped fashion within a groove 201*a* formed in a pump base 201 and is fixed between an outer peripheral portion of a cylindrical guide roller 203 which rotates about a guide roller shaft 202 provided on the pump base 201 and an inner wall of the groove 201*a*. In the tube 105*a*, at least a portion arranged within the groove 201*a* has flexibility so that the flexible portion of the tube 105 may be pressurized while a pressuring roller 205 rotating about a pressuring roller shaft 204 mounted on the guide roller 203, is in rotation within the groove 201*a*. On the other hand, the suction tube 105*b* communicated with the suction space 104*b* is also arranged in an arc-shaped fashion within a groove 301*a* formed in a pump base 301, in similar fashion as the tube 105*a*, and is fixed between the outer peripheral portion of a cylindrical guide roller 303 rotating about a guide roller shaft 302 and the inner wall of a groove 301*a*. It is similar to the tube 105*a* that at least a portion of the tube 105*b* to be arranged within the groove 301*a* has flexibility. On the other hand, a pressurizing roller 305 rotates about a pressurizing roller shaft 304 mounted on the guide roller 303.

In order to perform suction operation using the suction pump units set forth above, at first, in a condition where the suction cap 101 is urged onto the orifice surface of the printing head to fit in sealed position, the guide roller 203(303) is driven to rotate in the direction shown by arrow a. When the pressurizing roller 205(305) is located at X position or in the vicinity thereof, the pressurizing roller 205(305) is not in contact with the tube 105*a*(105*b*) and thus is not pressurizing the latter, the suction space 104*a*(104*b*) is held in communication with atmosphere. When the pressurizing roller 205(305) rotates into the Y position, the flexible portion of the tube 105*a*(105*b*) is compressed by the outer peripheral position of the pressurizing roller 205(305) so that the suction space 104*a*(104*b*) is blocked from communication with the atmosphere. Furthermore, when the guide roller 203(303) is rotated in the direction of arrow a, the pressurizing roller 205(305) is moved to the Z position with rotation in the direction of arrow 2. During this period, the compressed portion of the tube 105*a*(105*b*) is sequentially moved away from the suction space 104*a*(104*b*) to cause variation of volume. Due to variation (increasing) of volume, a negative pressure is generated in the suction space 104*a*(104*b*) to perform suction operation for the ejection openings 11(22).

Figure 5A:
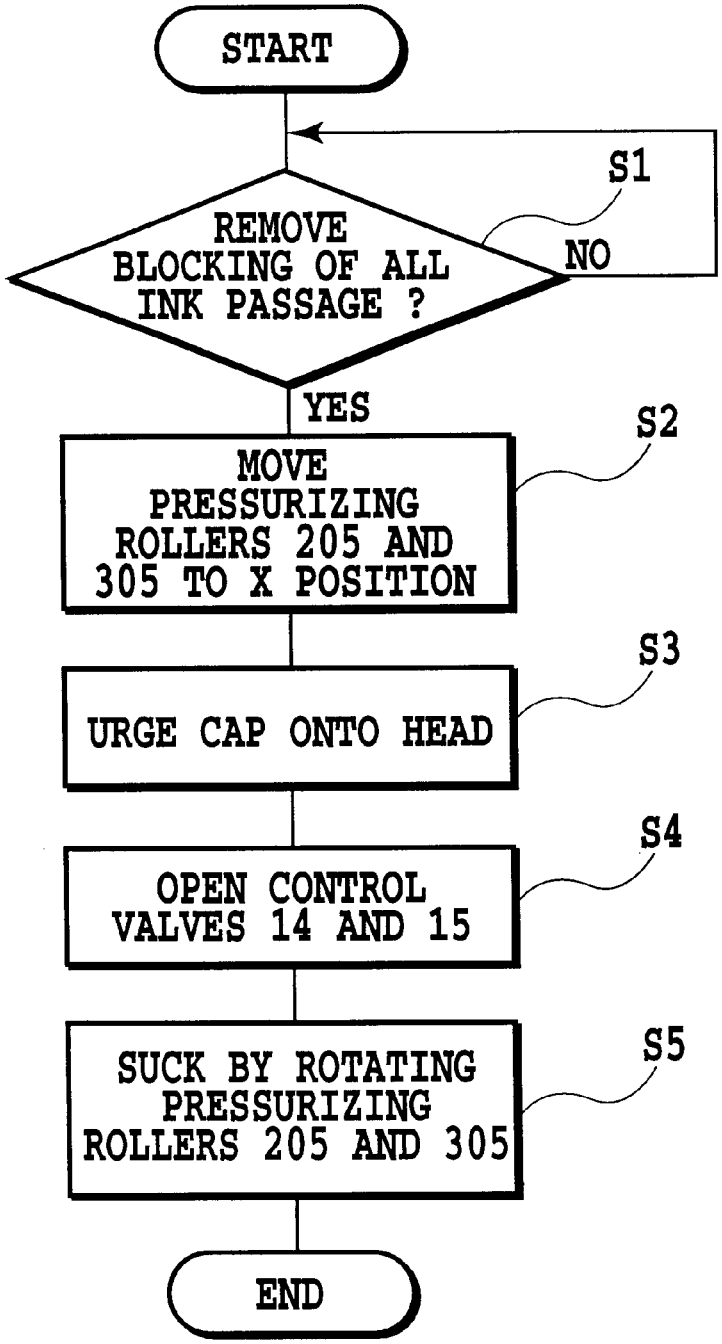
FIGS. 5A, 5B and 5C are flowcharts respectively showing several recovery operation in the first embodiment of the printing apparatus according to the present invention.
Figure 5B:
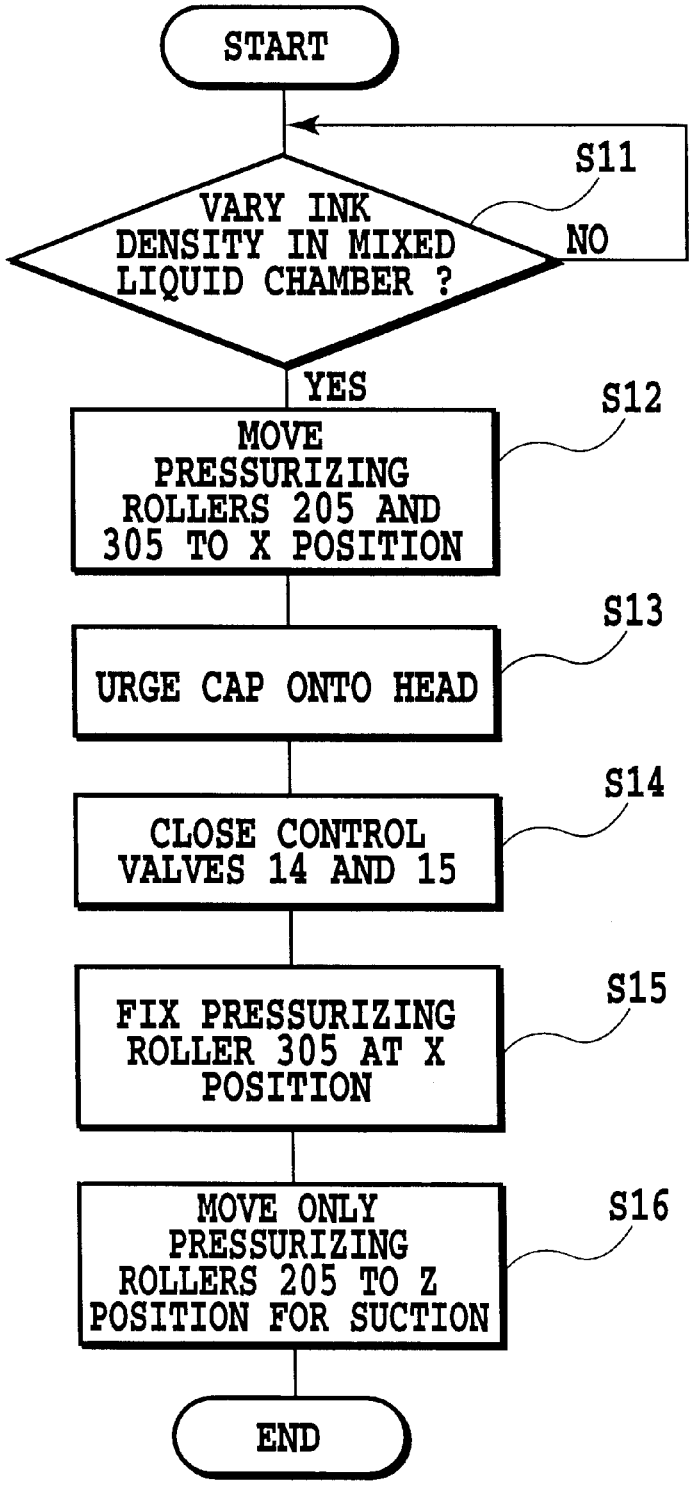
Figure 5C:
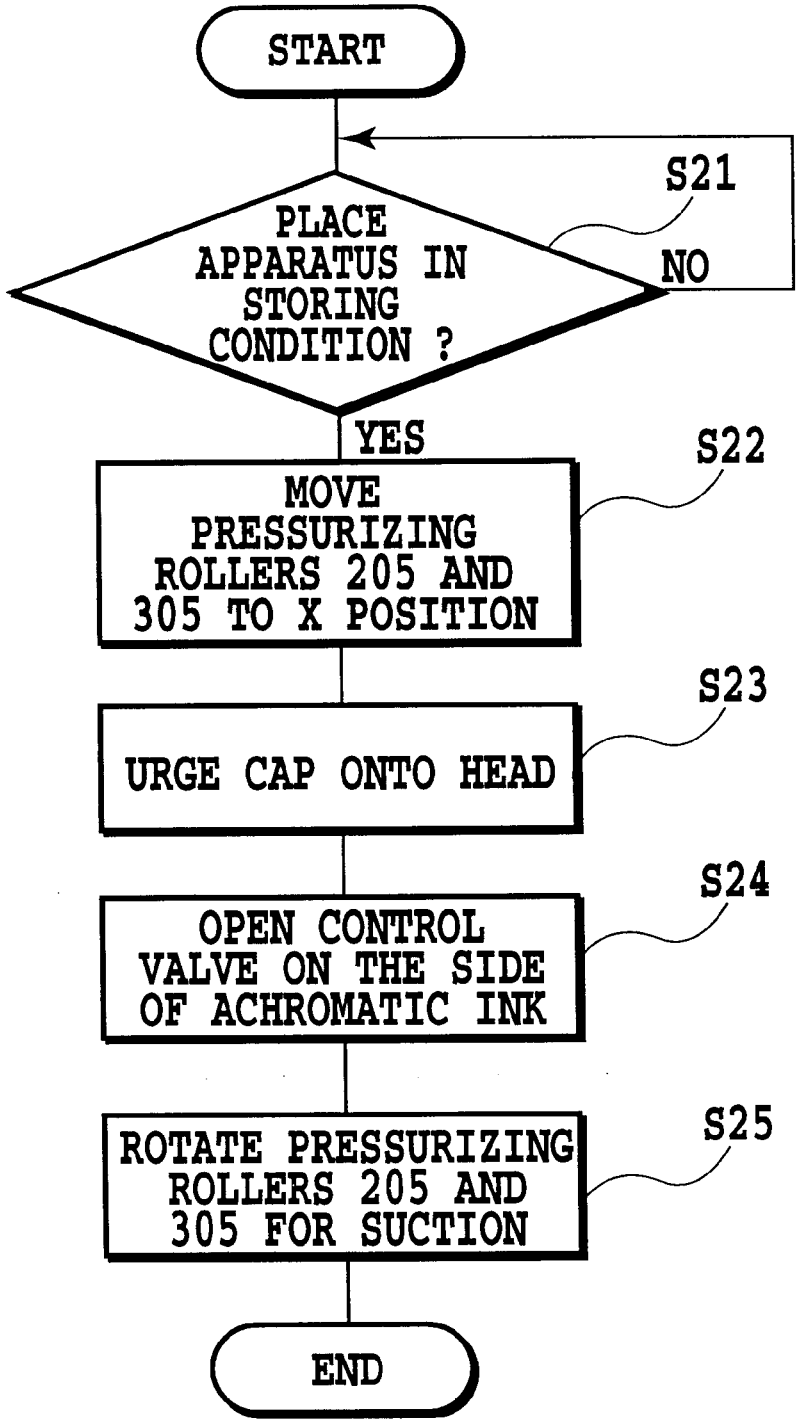

In the embodiment, it is possible to perform suction recovery operation in three ways as shown in FIGS. 5A, 5B and 5C by controlling the recording head, the suction cap and the suction pump.

(1) Recovery Operation for Removing Blocking of Either of Ink Passages 5 and 23

When there is a block on a flow path in either of the ink passages 5 and 23 caused by a foreign article mixed into ink, for example, a mode in which blocking of all ink passages is removed is established so as to surely remove the block. In the case that a judgement to remove blocking of all ink passages is made (step S1), pressurizing roller 205 and 305 is moved to X position (step S2) as shown in FIG. 5A. Next, the suction cap 101 is urged to the recording head so as to establish sealing contact to each other (step S3). Then, all of the control valves 14 and 15 in the printing head are opened (step S4). Next, pressurizing rollers 205 and 305 are rotated such that the pressurizing rollers 205 and 305 rotate at the same position on the guide rollers 203 and 303, in the same direction (a direction ) and at the same rotational speed (step S5). During the movement of the pressurizing rollers 205 and 305 from the Y position to the Z position, the suction spaces 104*a* and 104*b* become a negative pressure, so that ink is sucked out from the ejection openings 11 and 22 which are all of the ejection openings of the printing head set forth above.

(2) Recovery Operation for Varying Ink Density in Mixing Liquid Chamber

As shown in FIG. 5B, upon varying ink density in the mixing liquid chamber 8 (step S11), the pressurizing rollers 205 and 305 are moved to the X position, at first (step S12) to urge the printing head onto the suction cap 101 for establishing sealing contact (step S13). Next, here, all of the control valves 14 and 15 in the printing head are placed in closed condition (step S14). Next, after maintaining the suction space 104*b* in communication with the atmosphere via the tube 105*b* by fixing only pressurizing roller 305 at the X position (step S15), the guide roller 303 including the pressurizing roller 205 is rotated in the direction of arrow a (step S16). While the pressurizing roller 205 is moved from the Y position to the Z position, the suction space 104*a* becomes a negative pressure, and associating therewith, the suction space 104*b* communicated with the suction space 104*a* through the mixing liquid chamber 8 and the liquid chamber 23 becomes a slight negative pressure so as to introduce air from the ejection openings of the printing head. In such condition, all of the ink in the mixing liquid chamber 8 is temporarily discharged. Thereafter, by controlling the control valve 14 or 15 to open or close, predetermined density of the ink can be obtained. On the other hand, temporarily discharging all of the ink in the mixing liquid chamber may be advantageous as resulting in reduction of the waste ink amount.

(3) Recovery Operation for Placing Printing Apparatus in Storing Condition

As shown in FIG. 5C, upon placing the printing apparatus in storing condition (step S21), the pressuring rollers 205 and 305 are moved also to the X position (step S22) to urge the suction cap 101 onto the printing head for establishing sealing contact to each other (step S23). Next, here, assuming that achromatic ink is stored in the individual liquid chamber 9, after placing only the control valve 14 in opened position (step S24), both pressurizing rollers 205 and 305 are rotated in the same direction (direction a) at the same position of the guide rollers 203 and 303, respectively to drive both pressurizing rollers 205 and 305 at the same rotational speed (step S25). Thus, while the pressurizing rollers 205 and 305 are moved from the Y position to the Z position, the suction spaces 104*a* and 104*b* become a negative pressure to introduce the achromatic ink stored in the individual liquid chamber 9 into the mixing liquid chamber 8 to fill the liquid passages 5 and 23 and the ink ejection openings 11 and 22 with the achromatic ink. Here, "achromatic ink" means a liquid which does not contain any coloring agent at all. Even if the achromatic ink is filled in the liquid passages and the ink ejection openings, the coloring agent may not be solidified in an orifice surface including the ejection openings. Therefore, even when the printing apparatus is placed in storing condition not used to perform ink ejection or so forth for a long period, plugging of the ink ejection openings or the like can be avoided. It should be noted that "achromatic ink" can be preferably used even if the ink density is varied as explained in the section (2).

Figure 6:
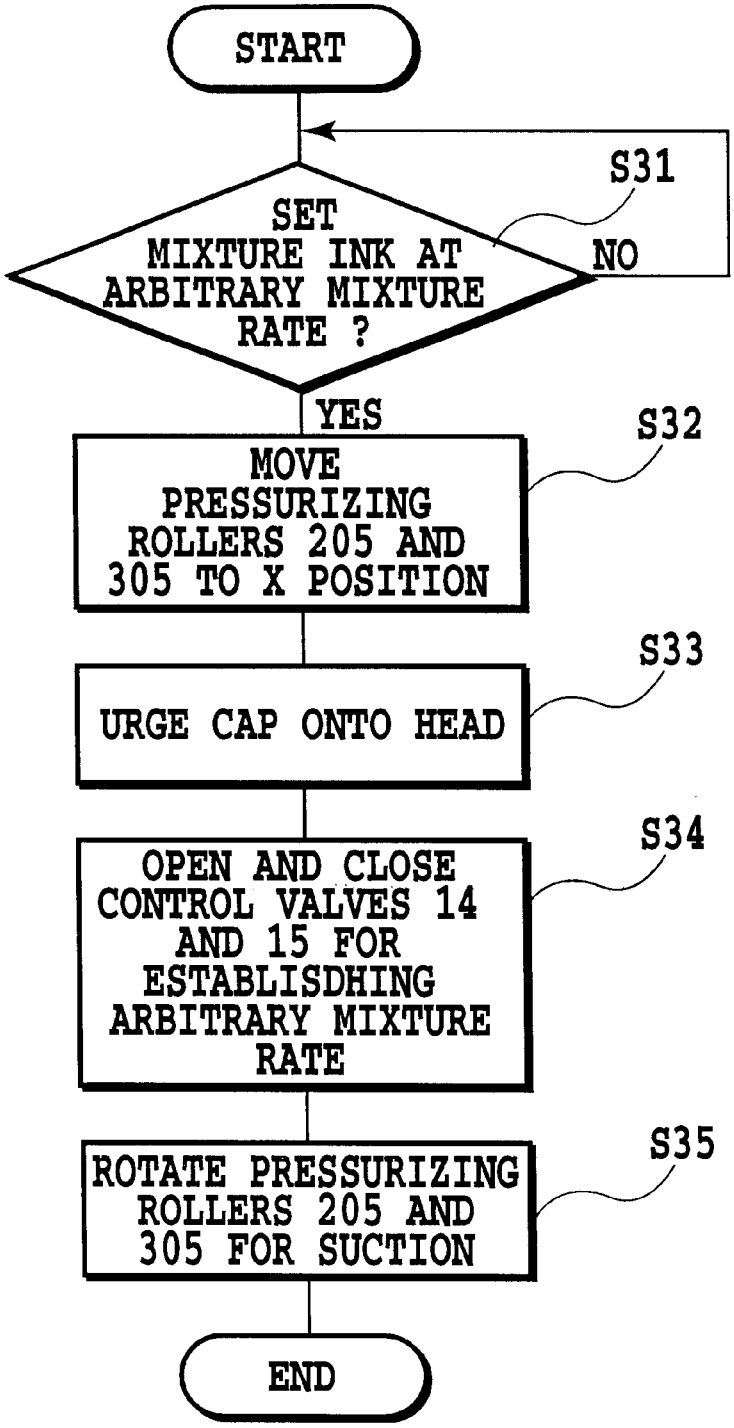
FIG. 6 is a flowchart showing a modification of recovery operation in the first embodiment of the printing apparatus according to the present invention.

It should be noted that the mixed ink can be arbitrarily varied the mixture ratio in a common liquid chamber which serves as the mixing liquid chamber 8, using a sequence illustrated in FIG. 6, in place of the mode explained in the section (2). Even in this case (step S31), at first, the pressurizing rollers 205 and 305 are moved to the X position (step S32) and the suction cap 101 is urged onto the printing head for establishing sealing contact (step S33). Next, for example, after placing the control valve 14*a* having the smallest open area among the control valves 14 shown in FIG. 1 and the control valve 15*c* having the largest open area among the control valve 15 in opening condition, and placing all other control valves in the closed position (step S34), both pressurizing rollers 205 and 305 are driven to rotate in the same direction (a direction) at the same positions of the guide rollers 203 and 303 for rotating the pressurizing rollers 205 and 305 at the same rotational speed (step S35). Accordingly, while the pressurizing rollers 205 and 305 are moved between the Y position to the Z position, the suction spaces 104*a* and 104*b* become a negative pressure. Thus, the mixed ink formed by mixing ink in the individual liquid chamber 9 and ink in the individual liquid chamber at a ratio of 1:4 is filled in the mixing liquid chamber 8. In this case, a period requiring for arbitrarily varying the mixture ratio of the mixture ink can be shortened. On the other hand, since the waste in amount can be made relatively small in the mode shown in (2) in comparison with the modification set forth immediately above, either method may be employed adapting to respective printing apparatus.

On the other hand, while the foregoing first embodiment forms the mixture ink of the arbitrary density by employing the achromatic ink and the ink having the coloring agent to eject from the printing head, hue of the ink can be varied by combining the ink having other coloring agent in place of the achromatic ink. Namely, as shown in FIG. 1, the yellow (Y) ink is stored in the individual liquid chamber 9 and the cyan (C) ink is stored in the individual liquid chamber 10, for example. Next, by controlling the control valves 14 and 15, a mixture ratio of both inks can be controlled precisely. In the case set forth above, variation of hue from yellow to green and then to cyan can be expressed by mixing both inks.

(Second Embodiment)

Figure 7:
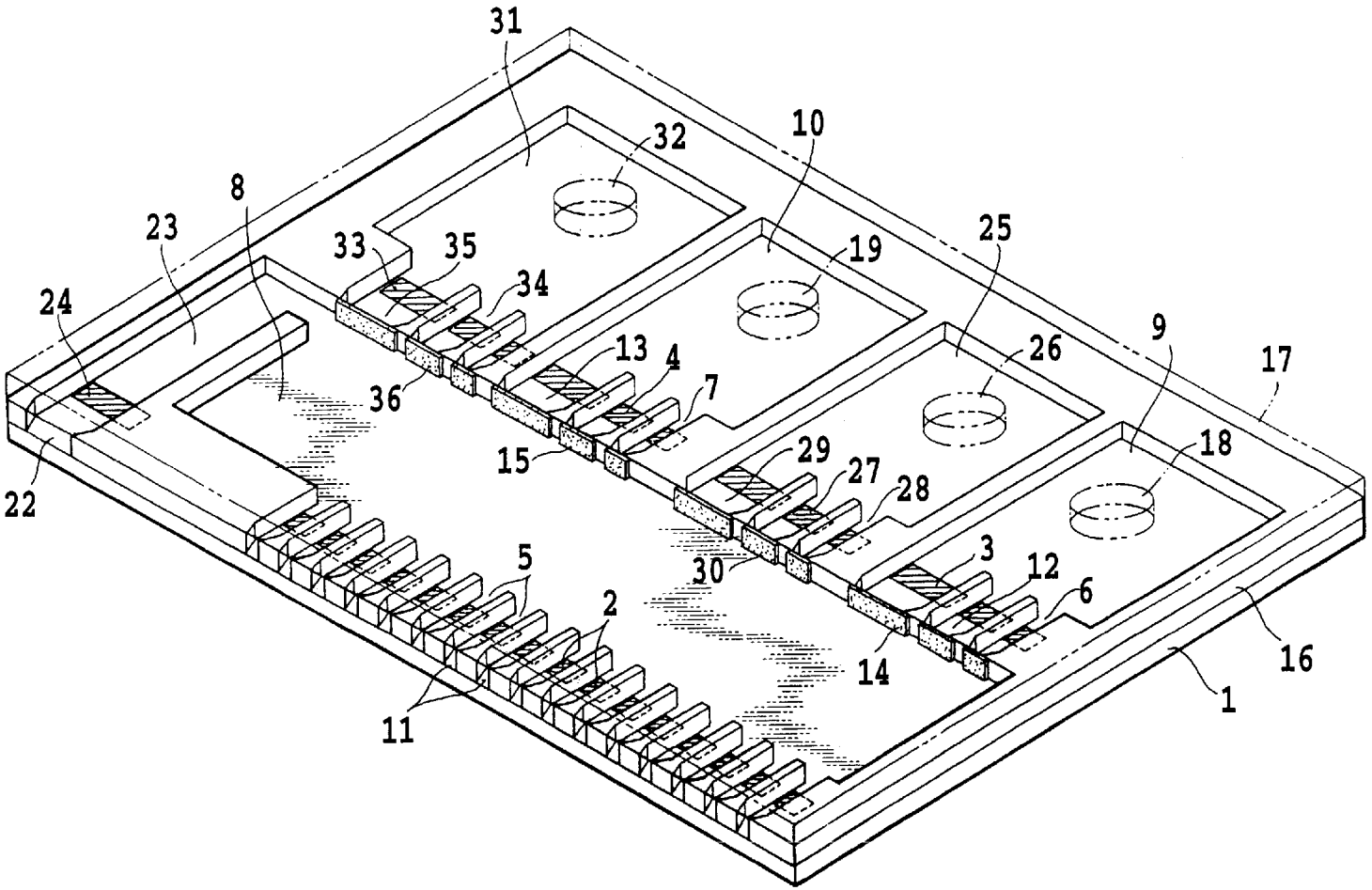
FIG. 7 is an exploded perspective view showing the major part of the second embodiment of the ink-jet printing head according to the present invention, which is shown in enlarged fashion.

FIG. 7 is an enlarged and exploded perspective view of the major part of the second embodiment of the printing head applicable for the ink-jet printing apparatus according to the present invention. Among the components of the shown embodiment, components common to the former first embodiment will be identified by the same reference numerals and explanation for such common components will be neglected for simplification of disclosure to facilitate clear understanding of the present invention.

Feature of the shown embodiment is that four individual liquid chambers 9, 10, 25 and 31 are arranged on the back side of one mixing liquid chamber 8. Constructions of new individual liquid chambers 25 and 31 are the same as the constructions of the individual liquid chambers 9 and 10. Namely, in an upper wall portion of the individual liquid chamber 25, an ink supply opening 26 is provided, and, in an front portion, a communication opening 29 is formed. In the communication opening 29, a control valve 30 is provided. In a bottom portion, a liquid passage 28 communicated with the communication opening 29 and an energy generating element 27 are provided. Similarly, in an upper wall portion of the individual liquid chamber 31, an ink supply opening 32 is provided, and, in an front portion, a communication opening 35 is formed. In the communication opening 35, a control valve 36 is provided. In a bottom portion, a liquid passage 34 communicated with the communication opening 35 and an energy generating element 33 are provided.

In the shown embodiment, the Y ink may be stored in the individual liquid chamber 9, the C ink may be stored in the individual liquid chamber 10, the magenta (M) ink may be stored in the individual liquid chamber 25, and an achromatic ink may be stored in the individual liquid chamber 31, for example. By providing four individual liquid chambers respectively containing different kinds of inks behind the mixing liquid chamber 8, all hue and density variation can be expressed. On the other hand, it can be adapted for storing of the printing apparatus appropriately.

(Third Embodiment)

Figure 8:
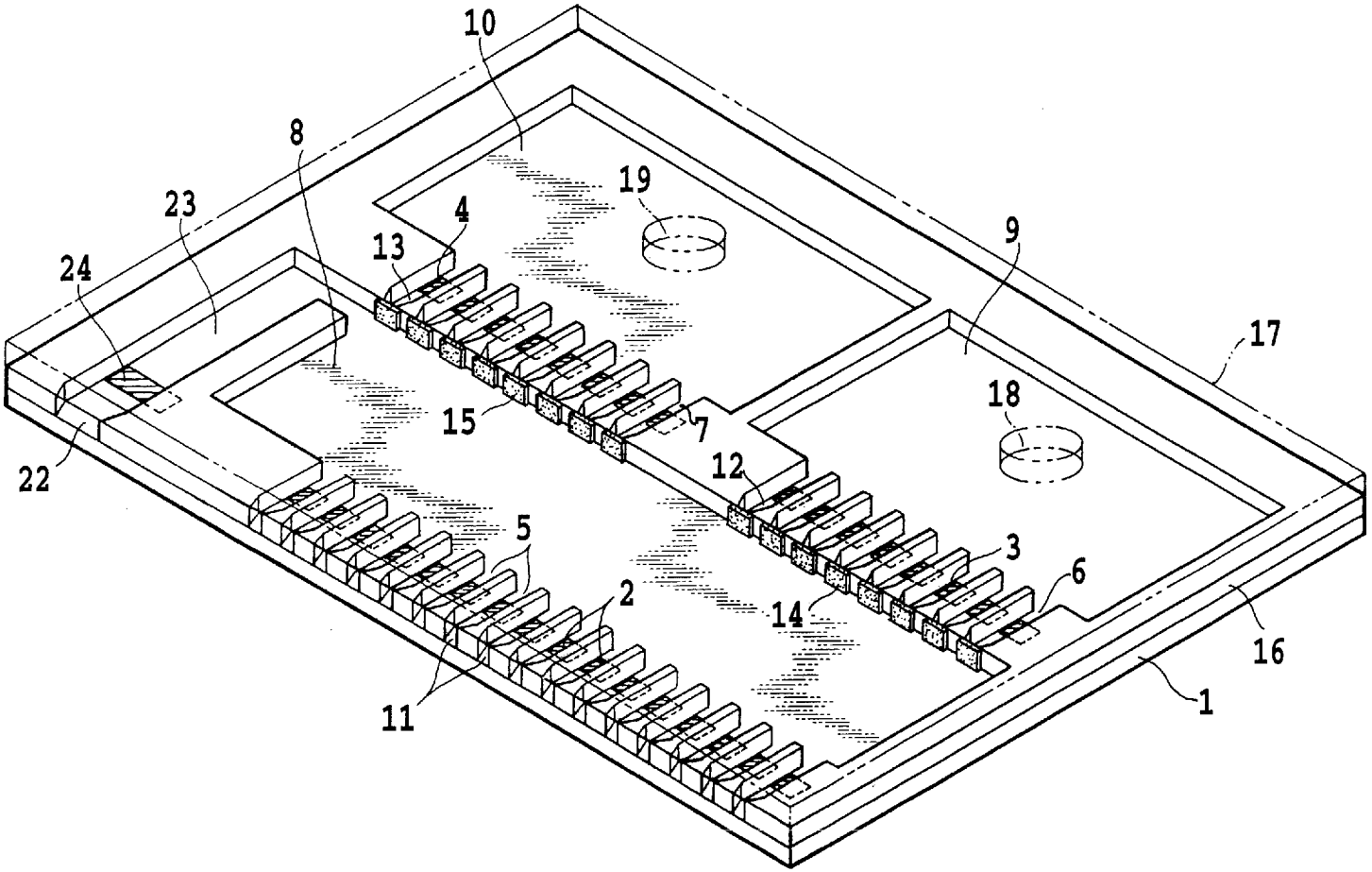
FIG. 8 is an exploded perspective view showing the major part of the third embodiment of the ink-jet printing head according to the present invention, which is shown in enlarged fashion.

FIG. 8 is an enlarged and exploded perspective view of the major part of the third embodiment of the printing head applicable for the ink-jet printing apparatus according to the present invention. Among the components of the shown embodiment, components common to the former embodiments will be identified by the same reference numerals and explanation for such common components will be neglected for simplification of disclosure to facilitate clear understanding of the present invention.

While the foregoing embodiments employ the control valves of different sizes corresponding to the opening area of the communication openings as shown in FIG. 1, for example, the shown third embodiment is characterized in employment of the same size of the communication openings and the control valves.

In the shown embodiment, supply amount into the mixing ink chamber, mixture ratio of the mixture ink therein and so on can be controlled by number of the control valves to be placed in the open condition. In this manner, variation of the ink density can be easily achieved similarly to the former embodiments.

On the other hand, in the shown embodiment, when a mixture ratio of the liquid in the liquid chamber 9 and the liquid in the liquid chamber 10 is 2:3, it is desirable to easily establish mixture in the mixing liquid chamber 8 by opening four control valves 14 and six control valves 15 rather than opening two control valves 14 and three control valves 15. Furthermore, upon opening a plurality of valves for respective liquid chambers, it is further preferred to easily form the mixture in the mixing liquid chamber 8 by opening control valves located at distant positions relative to each other.

(Fourth Embodiment)

Figure 9A:
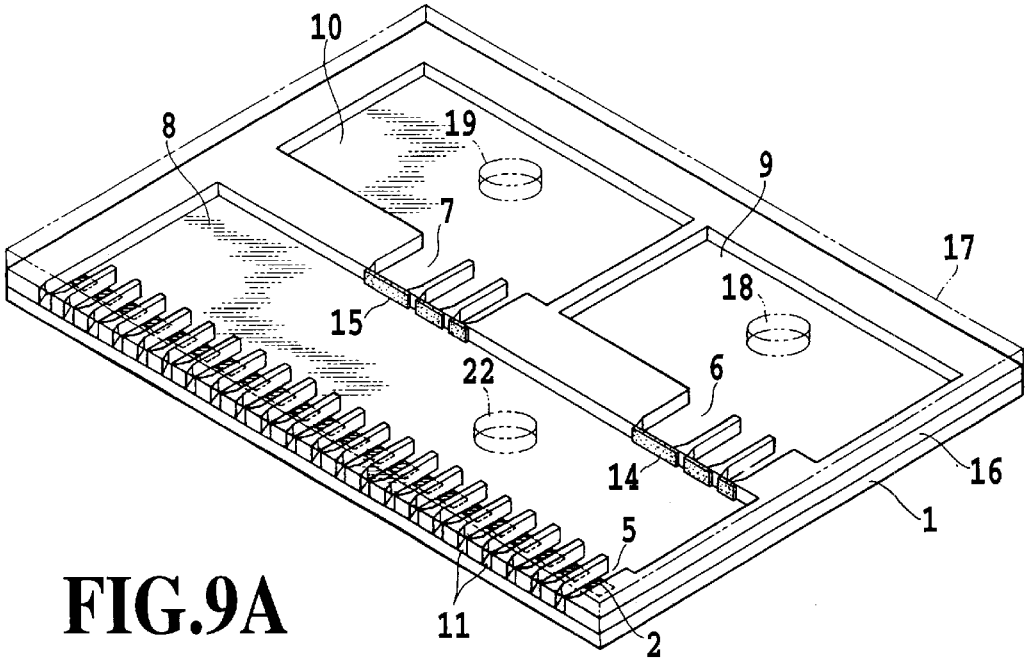
FIGS. 9A and 9B are exploded perspective views respectively showing the major part of the fourth embodiment of the ink-jet printing head according to the present invention, which is shown in enlarged fashion.
Figure 9B:
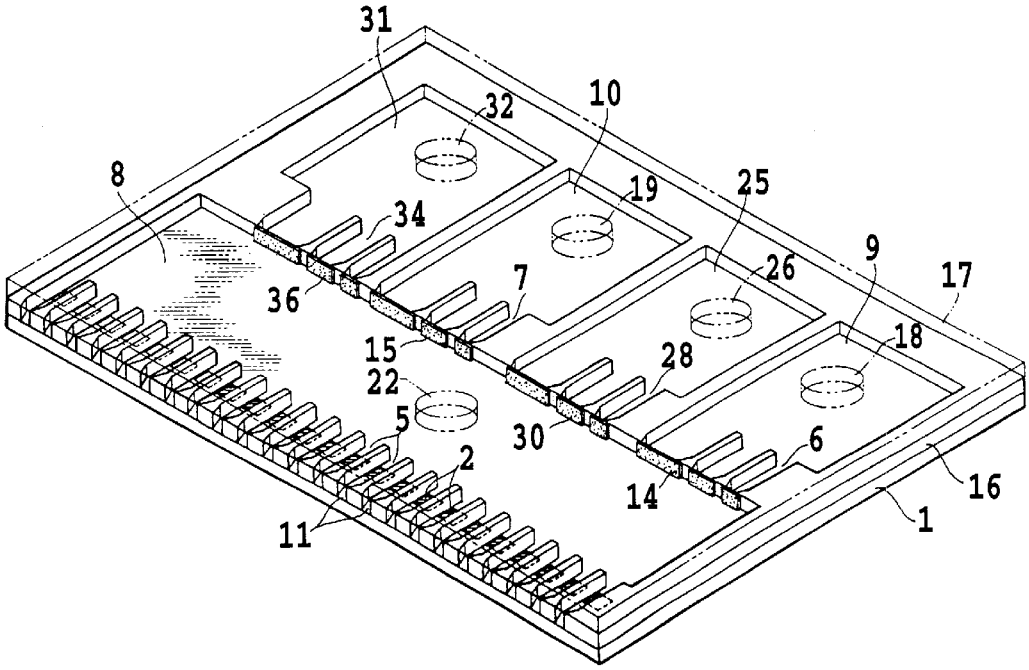

FIGS. 9A, and 9B are enlarged and exploded perspective views of the major part of the fourth embodiment of the printing head applicable for the ink-jet printing apparatus according to the present invention. The feature of the shown embodiment is in that a discharge opening 22 as an ink discharge passage is arranged in a direction intersecting with the ink supply direction from the individual ink chamber 9 or 10 to the mixing liquid chamber 8. The discharge opening 22 is provided in an upper wall portion similarly to the ink supply openings 18 and 19. FIG. 9A shows the printing head obtained by employing the shown embodiment in the first embodiment of the present invention, and FIG. 9B shows the printing head, to which the preferred embodiment of the present invention is applied to the second embodiment of the present invention. Among the components of the shown embodiment, components common to the former embodiments will be identified by the same reference numerals and explanation for such common components will be neglected for simplification of disclosure to facilitate clear understanding of the present invention.

In the printing head constructed as set forth above, as the cap member to be used for the suction operation for a plurality of ejection openings, it is not necessary to employ the cap member having separated two suction spaces by the rib 103 shown in FIG. 4A, and thus can employ a normal cap member. In this case, in the discharge opening 22 of the printing head, another suction pump (the pump connected to the tube 105*b* in the first embodiment) is employed.

While the foregoing embodiments employ the control valves of different sizes corresponding to the opening area of the communication openings, it may be possible to make the communication openings and the control valves in the same sizes. In this case, supply amount into the mixing ink chamber, a mixture ratio of the mixture ink therein and so on can be controlled by number of the control valves to be placed in the open condition. In this manner, variation of the ink density can be easily achieved similarly to the former embodiments.

(Fifth Embodiment)

Figure 10:
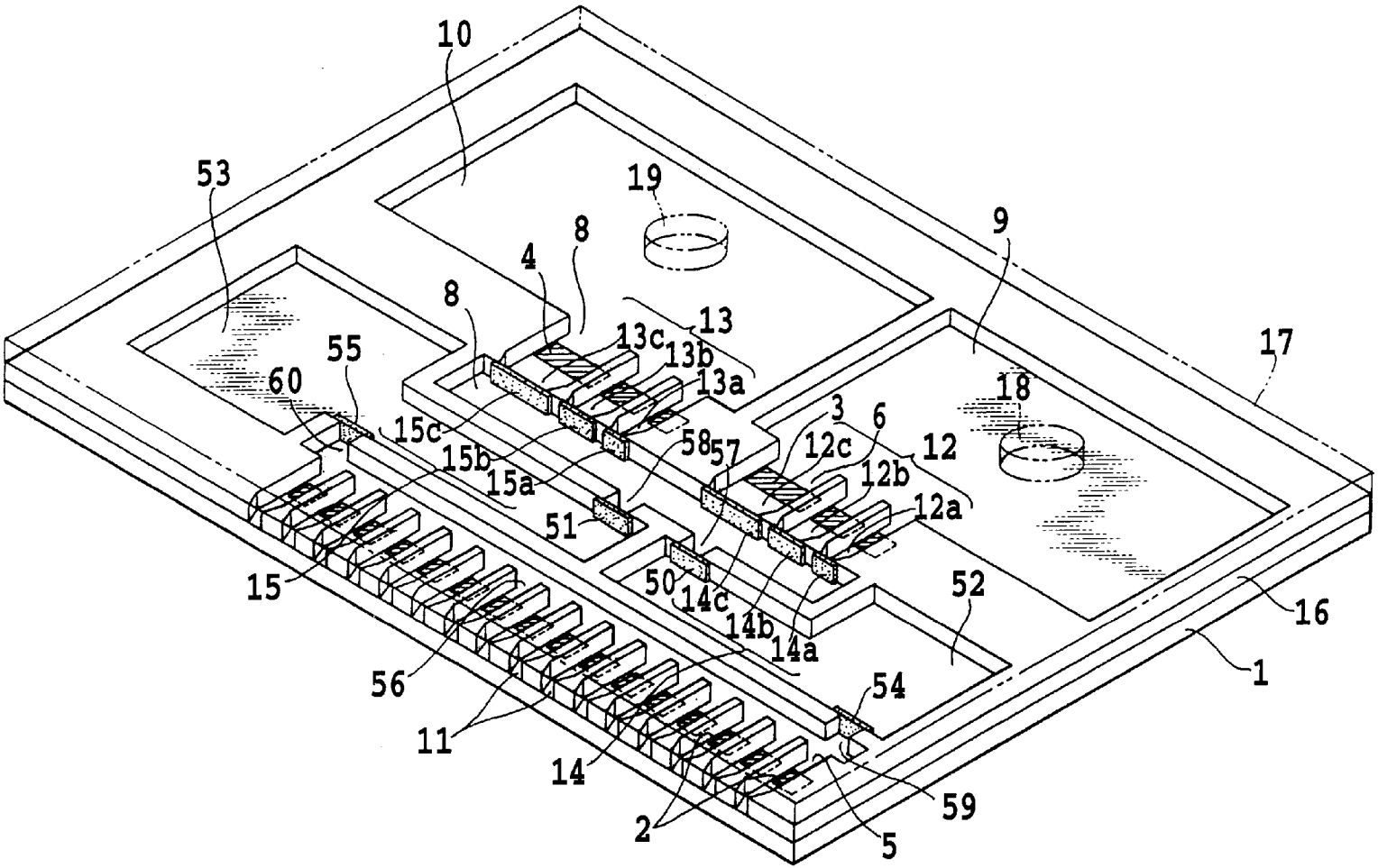
FIG. 10 is an exploded perspective view showing the major part of the fifth embodiment of the ink-jet printing head according to the present invention, which is shown in enlarged fashion.

FIG. 10 is an enlarged and exploded perspective view of the major part of the fifth embodiment of the printing head applicable to the ink-jet printing apparatus according to the present invention. Among the components of the shown embodiment, components common to the former embodiments will be identified by the same reference numerals and explanation for such common components will be neglected for simplification of disclosure to facilitate clear understanding of the present invention.

The feature of the shown embodiment is that one end side of an ejection liquid chamber 56, to which the rear end of the ink passages 5 are communicated, is connected to an intermediate liquid chamber 52 via a liquid passage 59, and the other end side of the ejection liquid chamber 56 is connected to an intermediate liquid chamber 53 via a liquid passage 60. In the liquid passages 59 and 60, control valves 54 and 55 serving as a third path control means which open and close the liquid passages are provided, respectively.

The intermediate liquid chamber 52 is connected to the mixing liquid chamber 8 via a liquid passage 57. In the similar manner, the intermediate liquid chamber 53 is connected to the mixing liquid chamber 8 via a liquid passage 58. In the liquid passages 57 and 58, control valves 50 and 51 serving as a second path control means for opening and closing the liquid passages, are provided, respectively. On the rear side of the mixing liquid chamber 8, two individual liquid chambers 9 and 10 are provided. The mixing liquid chamber 8 and the individual liquid chamber 9 are communicated through the communication opening 12. Likewise, the mixing liquid chamber 8 and the individual liquid chamber 10 are communicated through the communication opening 13.

Next, mixing and ejection of the ink in the printing head constructed as set forth above will be explained.

At first, the individual liquid chamber 9 and the individual liquid chamber 10 store mutually different kinds of inks. Each ink in the individual chamber 9 or 10 consists one component of a mixture ink to be prepared. For example, by simultaneously opening the smallest control valve 14*a* on the side of the individual liquid chamber 9 and the largest control valve 15*c* on the side of the individual liquid chamber 10 for a given period, inks at a ratio of 1:4 corresponding to sizes of the control valves can be introduced into the mixing liquid chamber 8. At this time, it is of course possible to promote movement of the ink by simultaneously driving the energy generating elements 3 and 4 respectively arranged at predetermined positions. Thus, the mixture ink having the mixture ratio set forth above can be prepared within the mixing liquid chamber 8. Next, by placing the control valves 50 and 54 in open position, the mixture ink in the mixing liquid chamber 8 can be introduced into the ejection chamber 56 via the intermediate liquid chamber 52. The mixture ink having the mixture ratio of 1:4, which is introduced into the ejection liquid chamber 56 is ejected through the ejection openings 11 through the ink passages 5.

Next, by simultaneously opening the control valves of the same size on the side of the individual liquid chamber 9 and on the side of the individual liquid chamber 10, the equal amount of the inks are introduced into the mixing liquid chamber 8 from both of the individual liquid chambers 9 and 10. Even in this case, by driving the energy generating elements 3 and 4 arranged at the predetermined positions in conjunction with opening of the control valves, movement of the ink may be promoted. Thus, the mixture ink having the mixture ratio 1:1 can be prepared within the mixing liquid chamber 8. Here, if the same path where the mixture ink having the mixture ratio of 1:4 has past, is used, it can cause variation of the mixture ratio. Therefore, other path, namely by placing the control valves 50 and 54 in closed position and placing the control valves 51 and 55 in open position, the mixture ink in the mixing liquid chamber 8 is introduced into the ejection liquid chamber 56 via the intermediate liquid chamber 53. At this time, it becomes necessary to preliminarily eject or discharge the mixture ink having mixture ratio of 1:4 in the ejection liquid chamber 56. However, the ejection liquid chamber 56 has much smaller storage volume in comparison with the mixing liquid chamber in the printing head construction in the first embodiment shown in FIG. 1. Therefore, consumption of the ink can be minimized.

It should be appreciated that the foregoing method takes steps to introduce the mixture ink into the intermediate liquid chamber after preparing the mixture ink in the mixing liquid chamber 8. By introducing the once prepared mixture ink into the intermediate liquid chamber, uniform mixture can be certainly attained. Of course, it is possible to supply respectively predetermined amounts of inks from respective individual liquid chambers after establishing communication between the mixing liquid chamber and the intermediate liquid chamber by preliminarily opening the control valve 50 or 51, in place of the steps set forth above. In this case, as will be explained with respect to the embodiment shown in FIG. 15, partitioning walls between the mixing liquid chamber 8 and the intermediate liquid chamber 52, 53 may serve as partitioning wall for stirring the ink to attain more uniform mixture of two inks supplied via the control valves 14, 15.

On the other hand, it is also possible to store the ink containing the coloring agent in one of the individual liquid chamber 9 and the ink containing no coloring agent in the other individual liquid chamber 10, and to mix these liquids in the mixing liquid chamber 8 so as to enable ejection of an appropriate density of ink through one printing head.

On the other hand, in the shown embodiment, since the shown embodiment permits variation of the density with maintaining the size of the ink droplet constant, higher quality printing becomes possible. Furthermore, since the desired density of the ink can be prepared within the mixing liquid chamber immediately before ejection, it becomes unnecessary to provide a plurality of printing heads and inks of different densities. In addition, since an amount of the residual ink upon switching of the ink can be made small, ink consumption amount and switching period can be minimized.

(Sixth Embodiment)

While the former fifth embodiment performs mixing of the mutually different kinds of inks using one mixing liquid chamber, it may be possible that the density of the mixture ink can be slightly differentiated from the desired density due to the presence of the residual ink in the mixing liquid chamber upon switching of the color. Therefore, in the shown embodiment, by providing dedicated mixing liquid chambers corresponding to two individual liquid chambers, influence of the mixture ink before switching of color can be avoided as much as possible.

Figure 11:
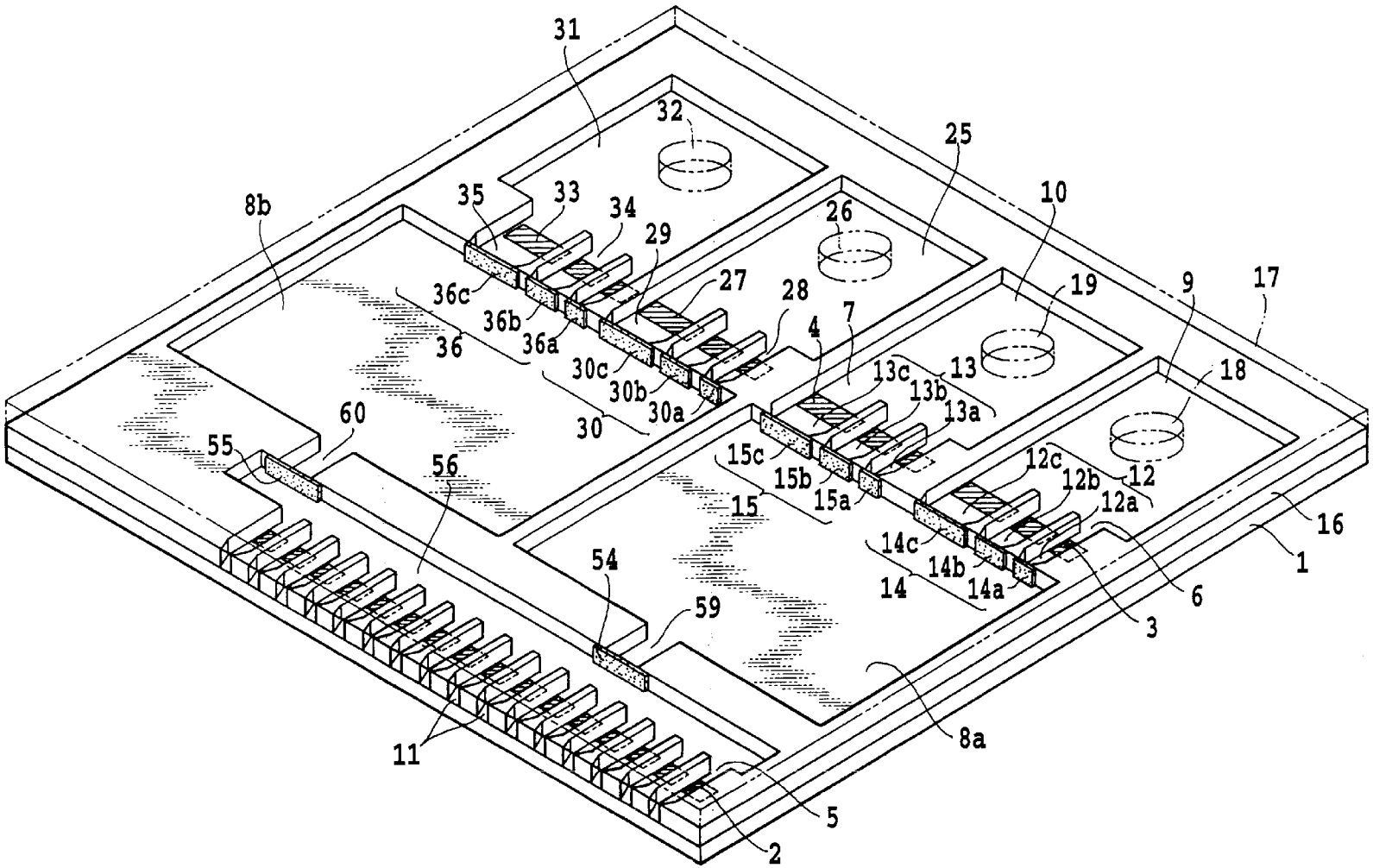
FIG. 11 is an exploded perspective view showing the major part of the sixth embodiment of the ink-jet printing head according to the present invention, which is shown in enlarged fashion.

FIG. 11 is an enlarged and exploded perspective view of the major part of the ink-jet printing apparatus according to the present invention. Namely, in FIGS. 11, 8*a* and 8*b* denote two mixing liquid chambers. To one of the mixing liquid chamber 8*a*, the individual liquid chambers 9 and 10 having the same construction as those in the former fifth embodiment are connected. To the other mixing liquid chamber 8*b*, the individual liquid chambers 25 and 31 having the same construction as the individual liquid chambers 9 and 10 are connected. It should be noted that, in the shown embodiment, the intermediate liquid chambers provided in the former fifth embodiment are not provided. On the other hand, in the individual liquid chamber 25, the energy generating elements 27, the liquid passages 28 and the communication openings 29 are formed at respectively predetermined positions, and in the individual liquid chamber 31, the energy generating elements 33, the liquid passages 34 and the communication openings 35 are formed at respectively predetermined positions. In the upper wall portion of the individual liquid chamber 25, the ink supply opening 26 is formed, and in the upper wall portion of the individual liquid chamber 31, the ink supply opening 32 is formed.

Furthermore, between the individual liquid chamber 31 and the mixing liquid chamber 8*b*, the control valve 36 constituted of three separate valves 36*a*, 36*b* and 36*c* is provided. In a similar manner, between the individual liquid chamber 25 and the mixing liquid chamber 8*b*, the control valve 30 constituted of three separate valves 30*a*, 30*b* and 30*c* is provided. Among the components of the shown embodiment, components common to the former embodiments will be identified by the same reference numerals and explanation for such common components will be neglected for simplification of disclosure to facilitate clear understanding of the present invention.

In the printing head constructed as set forth above, inks containing coloring agents are stored in the individual liquid chambers 9 and 25 and liquid not containing the coloring agent is stored in the individual liquid chambers 10 and 31, for example. Then, for example, the mixture ink having the mixture ratio of 1:4 can be prepared on the side of the mixing liquid chamber 8*a*, and the mixture ink having the mixture ratio of 1:1 can be prepared in the mixing liquid chamber 8*b*. Upon ejecting each mixture ink, one of the control valves 54 and 55 is placed in open position and to place the other in closed position. Thus, by controlling opening and closing of the control valves 54 and 55, switching of the color can be easily performed. On the other hand, upon switching of the color, it becomes necessary to eject or discharge the residual ink in the ejection liquid chamber 56. However, it can be performed to eject or discharge only the residual ink in the ejection liquid chamber 56, so that ink consumption amount can be minimized.

In the embodiment set forth above, by providing a plurality of mixing liquid chambers and by selecting the ink passage from one of the mixing liquid chambers to the means for controlling ejection of the ink, admixing amount of the ink used for the preceding color to the ink to be currently ejected can be made small upon switching of the density of the ink to be ejected. Therefore, variation of the ink density can be made further smaller.

(Seventh Embodiment)

Figure 13:
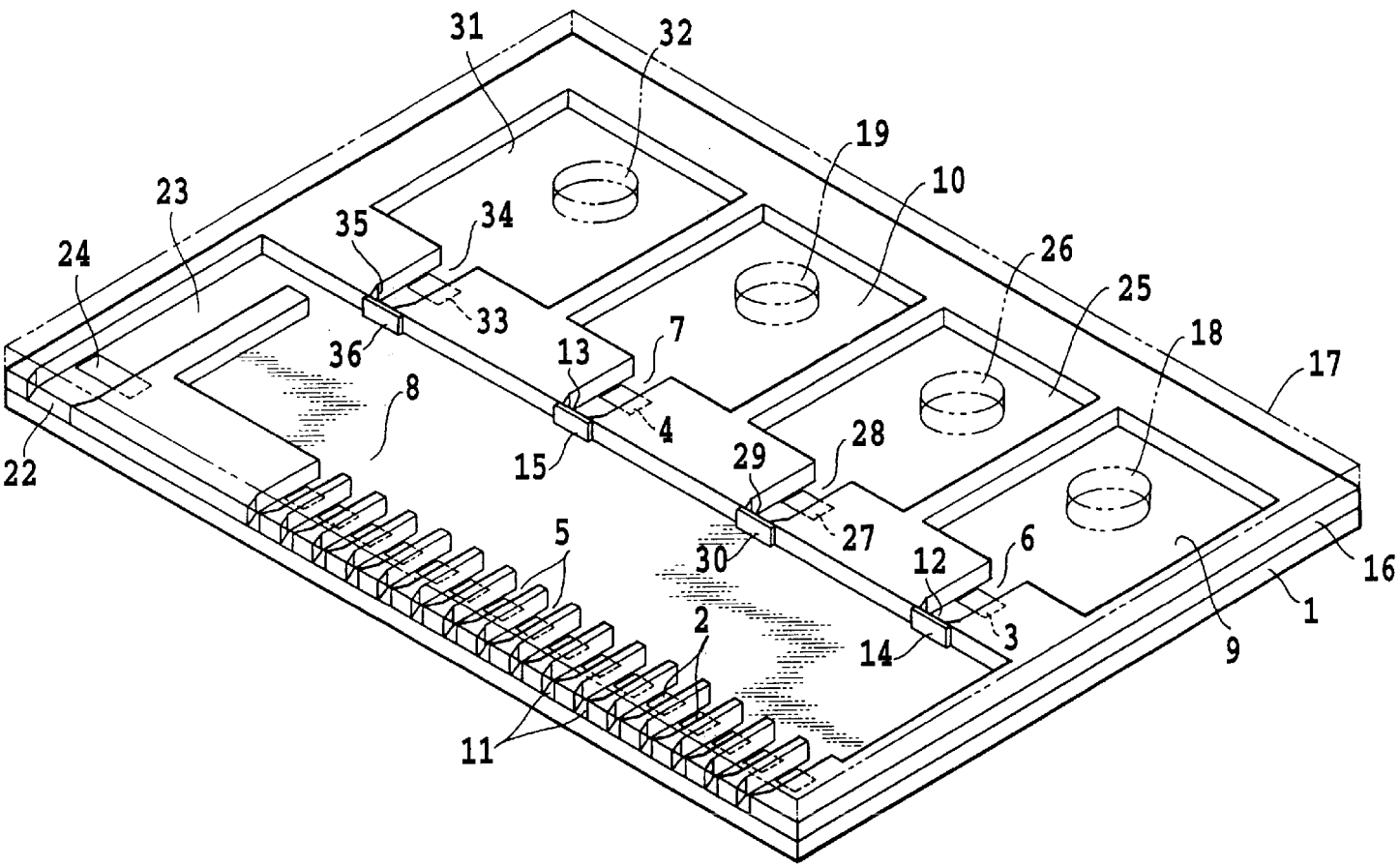
FIG. 13 is an exploded perspective view showing the major part of the seventh embodiment of the ink-jet printing head according to the present invention, which is shown in enlarged fashion.

FIG. 13 is an enlarged and exploded perspective view of the major part of the seventh embodiment of the printing head applicable to the ink-jet printing apparatus according to the present invention. Among the components of the shown embodiment, components common to the former embodiments will be identified by the same reference numerals and explanation for such common components will be omitted for simplification.

The feature of the shown embodiment is that it stores inks of different densities in the ink chambers 9, 10,25 and 31 for supplying inks and selectively supplies the inks to the ink chamber 8 for printing so as to make the density of the ink in the ink chamber 8 corresponding to the density level of an image data. To this end, in the shown embodiment of the printing head, each communication passage between each ink chamber for supplying ink and the ink chamber for ejecting are communicated with a single passage.

Figure 12:
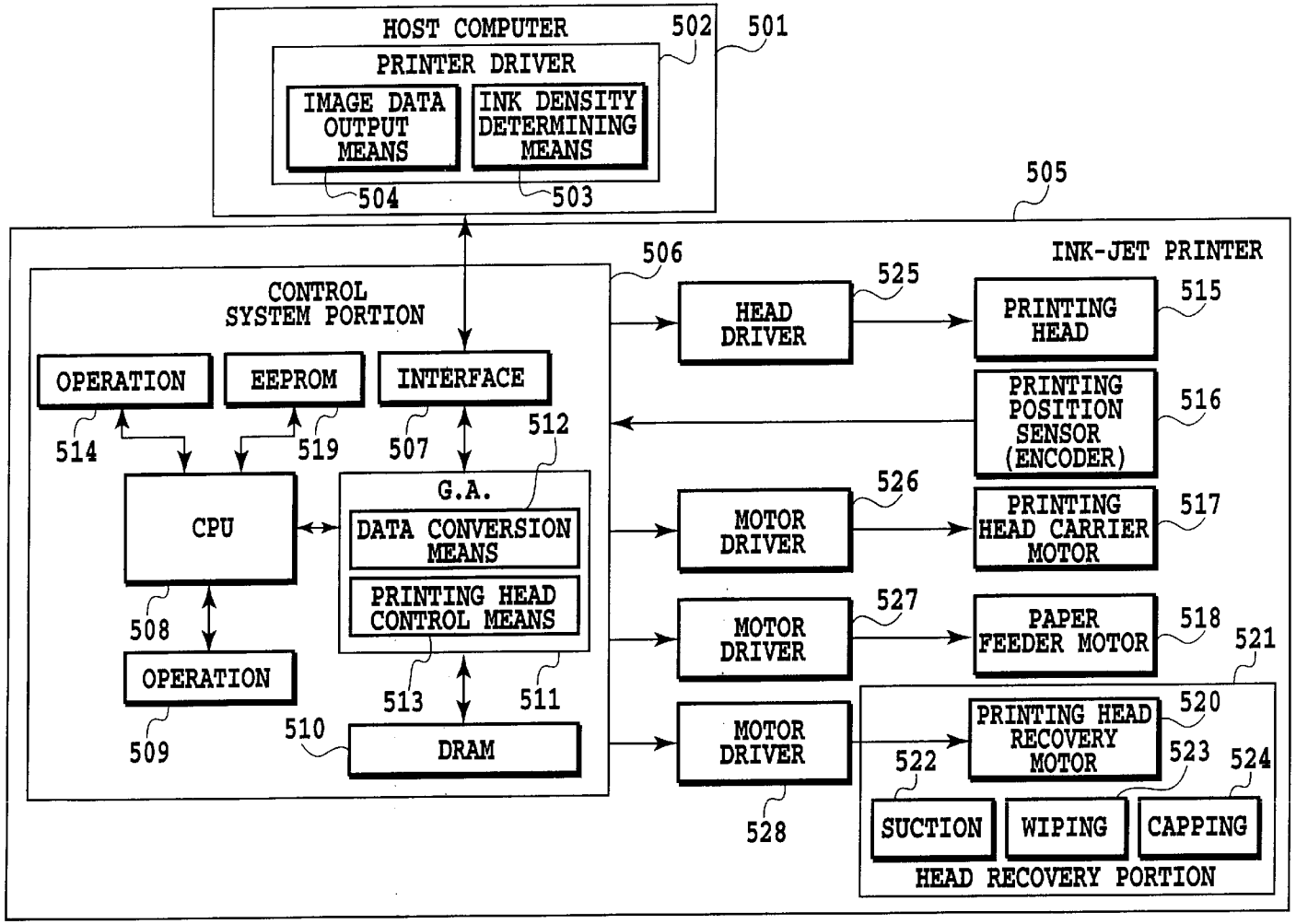
FIG. 12 is a block diagram of a control system in the seventh embodiment of an ink-jet printing apparatus according to the present invention.

Next, a host computer and an ink-jet printing apparatus to be associated with the seventh embodiment of the present invention will be explained. FIG. 12 is a block diagram showing a construction of a control system in the host computer and the ink-jet printing apparatus.

In the block diagram in FIG. 12, reference numeral 501 denotes a host computer, in which a system program manages executing condition of various application programs based on a predetermined OS. A printer control program (printer driver) 502 operative on the system program is consisted of an ink density determining means 503 for determining density of the ink to be used upon recording, such as printing for each color of black, magenta, cyan and yellow, and image data output means 504 for outputting a density data and an image data of the ink to be used in the printing head to a printer 505, with respect to the image data generated on various application programs.

Reference numeral 506 denotes a control system portion in the printer 505. Reference numeral 507 denotes an interface for taking the image data into the printer 505 from the host computer 501, which is parallel or serial interface. Reference numeral 508 denotes CPU which performs start-up process of the printer 505, drive control for various motors, head recovery operation, time control and so forth. Reference numeral 509 denotes a program ROM storing various control programs to be executed by CPU 508. Reference numeral 510 denotes DRAM which forms storage means for temporarily storing printing data to be transferred to a printing head 516.

Reference numeral 511 denotes a gate array which includes data conversion means 512 and print control means 513 operative on the basis of the image data and an ink density data transferred from the host computer 501. The former data conversion means 512 converts the image data into a print data. The latter print control means 513 performs control for varying ink density in the printing head 515 according to the ink density data and ink ejection drive control by transferring the print data to the printing head 515. Reference numeral 514 denotes an operation portion, on which a start-up switch for placing the printer in a print enabled state (ON LINE), a light emitting diode (LED) for visually indicating print enabled state are mounted. Reference numeral 519 denotes storage means for holding information for managing the printing head 515.

The same kind of printing heads 515 are set for respective ink colors.

Reference numeral 516 denotes a position sensor (encoder) for detecting a printing position. Reference numeral 517 denotes a carrier motor for moving the printing head 515, and 518 denotes a paper feeding motor for feeding printing paper. Reference numeral 521 denotes a head recovery portion for maintaining ink ejection performance of the printing head 515. Reference numeral 520 denotes a recovery motor for performing head recovery operation (suction operation portion 522, wiping operation portion 523, capping operation portion 524). Reference numeral 525 denotes a head driver for driving the printing head 516, and reference numerals 526, 527 and 528 denote motor drivers for driving carrier motor 517, paper feeder motor 518 and recovery motor 520, respectively.

Next, operation of the print control system, such as printing in the host computer and the ink-jet printing apparatus will be explained.

For example, upon performing printing operation as recording operation, at first, the image data generated by various application programs which can be operated on the predetermined OS in the host computer 501, is input into the ink density determining means 503 in the printer control program (printer driver) 502. The ink density determining means 503 determines ink densities to be used for printing with respect to respective ink colors of black, magenta, cyan and yellow. In the ink density determining means 503, the density data of each color ink in the printing head 515 is managed. For example, when inks respectively having four mutually different densities are filled with respect to respective ink colors of black, magenta, cyan and yellow as the printing head 515 used in the shown embodiment of the ink-jet printing apparatus, the ink density determining means 503 determines which density of the ink among four densities of ink, for the image data, to select optimal one therein. Then, the image data output means 504 outputs the density data of the ink to be used (ink density data) and the image data to the printer 505 through the interface 507.

The image data transferred to the printer 505 is converted into the print data for printing the image data by the data converting means 512 in the gate array 511. Next, the ink density data of each color to be transferred from the host computer 501 and the print data after data conversion are fed to the head control means 513. The control means 513 controls the printing head 515 and the head recovery portion 521 according to the ink density data of each color before initiation of printing to fill the ink within the ink chamber 8 for printing. Then, before initiation of printing, the print data is transferred to the printing head to perform printing by controlling the ejection energy generating elements 2.

As a particular embodiment, in the printing head 515 for one color, explanation will be given for the case where the ink in the ink chamber 9 for ink supply is selected as printing ink, namely the ink to be filled in the ink chamber 8 for printing. At first, before initiation of printing, the control valve 14 in the printing head 515 is controlled so as to be opened. Next, by the head recovery portion 521, suction operation is performed from the ejection openings 11 and 22 to sufficiently fill the ink chamber 8 for printing with the ink in the ink chamber 9 for ink supply. Then, upon initiation of printing, according to the print data, printing is performed by controlling the ejection energy generating elements 2. At this time, in synchronism with control of the ejection energy generating elements 2, control of the energy generating element 3 is performed for constantly filling the ink chamber 8 for printing with the ink having the selected density. Thus, it becomes possible to select the ink density for reproducing the image data with high fidelity and to eject the selected ink from the same nozzle.

On the other hand, the ink density in the printing head 515 of respective inks selected upon printing can be varied per printing for one page. However, the ink density may also be varied per one scan. In such a case, the ink density determining means 503 in the printer control program (printer driver) 502 determines ink density to be used for printing for respective colors of black, magenta, cyan and yellow per one scan of the print data. Then, the image data output means 504 transfers respective ink density data at the same timing of transferring of the image data for one scan. On the side of the printer 505, the printing head 515 and the head recovery portion 521 are controlled on the basis of the ink density data transferred per one scan for varying the ink density in the printing head 515 per each color. By varying the ink density per one scan, it becomes possible to print the image data with higher fidelity.

It should be noted that, in the seventh embodiment of the print control system of the host computer and the ink-jet printing apparatus set forth above, when the ink density determining means 503 in the printer control program (printer driver) determines the ink densities to be used for printing with respect to respective colors of black, magenta, cyan and yellow for the image data generated by various application programs in the host computer 501, only inks of various densities residing in the printing head may not print the optimal output image relative to the image data.

Therefore, when the ink density determining means 503 makes judgment that the optimal output image for the image data cannot be printed, it is possible that two or more kinds of density inks are selected and mixed at equal proportion to prepare an ink with new density in order to reproduce the image data with high fidelity.

On the other hand, instead of selecting two or more density inks and mixing the selected inks at the equal proportion, ink having lighter density than the density of the image data is selected and printing scan of the printing head 515 is performed for more than or equal to two times for the predetermined printing position with the selected ink. In this case, it is also possible to perform printing with varying the ink density per printing scan. By performing printing control set forth above, range of the density of the printed output image is expanded to permit more precise gradation expression.

On the other hand, as further modification, a reducer ink for reducing ink density without varying composition of the ink as mixed with other ink as set out in the first embodiment, is provided in the printing head. When the ink density determining means 503 in the print control program (printer driver) 502 makes judgment that the optimal output image cannot be printed only by the three density levels of inks in the printing head 515 for the image data generated by various application program in the host computer 501, one of three levels of the inks and the reducer ink may be selected to mix them so as to prepare a new density ink, then utilizing the new density ink to perform printing of the image data with high fidelity. By performing print control, range of the ink density to be selected can be expanded to permit more precise gradation expression.

(Eighth Embodiment)

Figure 14:
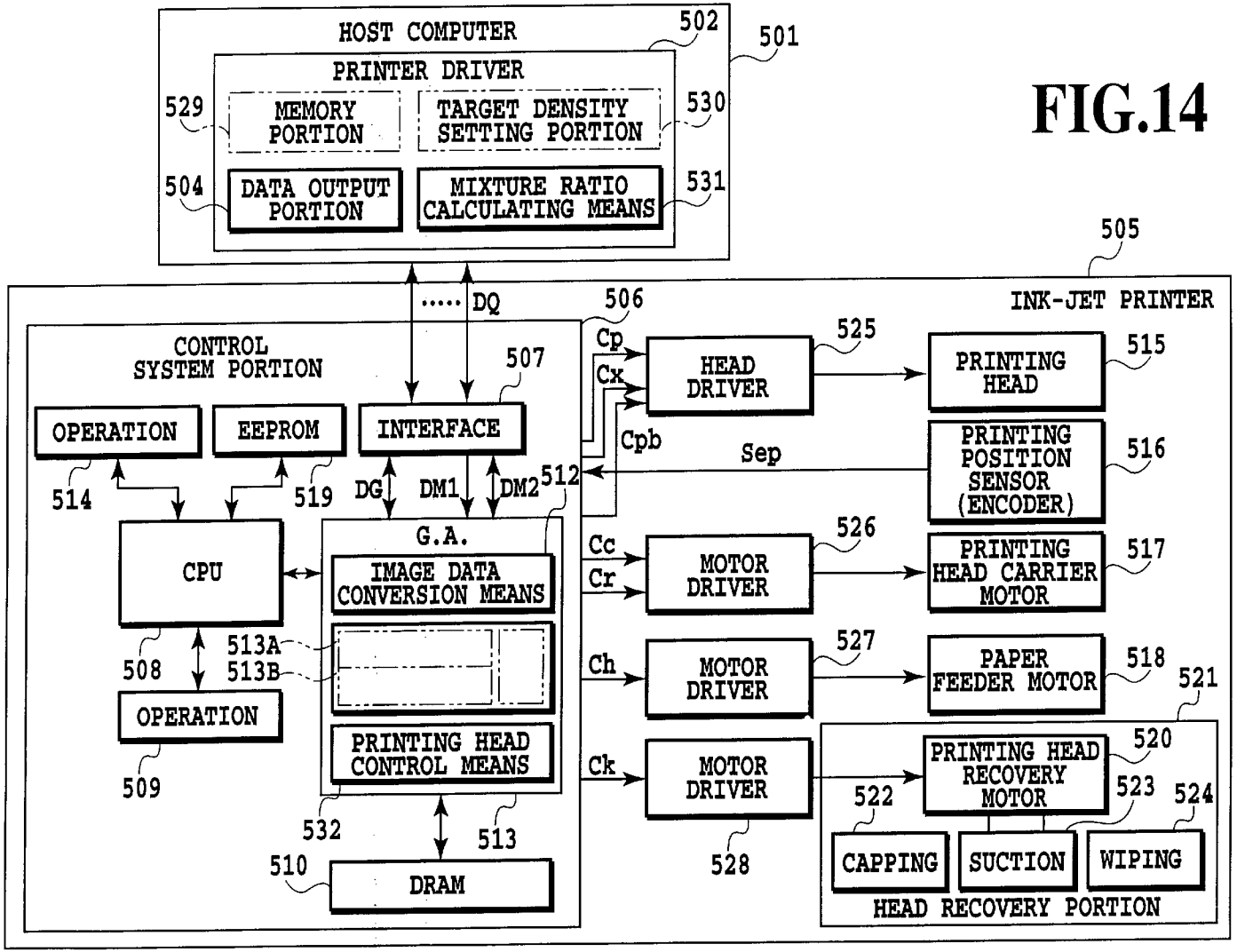
FIG. 14 is a block diagram of a control system in the eighth embodiment of an ink-jet printing apparatus according to the present invention.

FIG. 14 is a block diagram showing a construction of the eighth embodiment of the control system in the host computer and the ink-jet printing apparatus according to the present invention. The feature of the shown embodiment is to perform printing using an ink of optimal density or optimal color tone in consideration of the ink already existing in the liquid chamber, in the foregoing first embodiment.

In FIG. 14, the control system 506 of the ink-jet printing apparatus is connected to the host computer 501 through a predetermined bi-directional bus. In the host computer 501, the system program manages execution states of various application programs on the basis of the predetermined OS.

The print control portion (printer diver) 502 of the host computer 501 which operates on the system program includes a target density setting portion 530 for setting a target density which is relatively high frequently used, for various inks on the basis of the image data, a mixture ratio calculating portion 531 for calculating a mixture ratio of respective inks such that densities of the inks in respective ink chambers 8 of the printing head 515 become the target density set by the target density setting portion 530 as the respective inks are mixed, a memory portion 529 storing the image data and the ink density data indicative of respective ink densities which can reproduce more precise gradation expression of the respective image data in a form of a map corresponding to the respective image data, data respectively indicative of the densities of the inks stored in respective of the ink mixing chamber 8 and respective supply ink chambers 9 and 10, a target density data and a mixture ratio data which will be explained later and so on, and the data output portion 504 for outputting various data to the printer 505.

The image data stored in the memory portion 529 is a multi-value data consisted of three bits per one pixel with respect to each kind of inks, i.e. black, magenta, cyan and yellow, for example. Accordingly, each data per each color is expressed by seven values to represent any one of seven gradation levels. The ink density data in each ink mixing chamber 8 is updated when a new ink is mixed as set out later.

On the other hand, the ink density data is expressed using a histogram per each ink color.

The target density setting portion 530 sets respective target densities at relatively high frequency of use with respect to density of the inks in respective ink mixing chambers 8 with reference to the ink density data on the basis of the image data for one scan or one page from the memory portion 529.

The mixture ratio calculating portion 531 calculates a mixture ratio, on the basis of the target density set by the target density setting portion 530, so that density of ink prepared before printing operation by mixing a predetermined amount of residual ink in the ink mixing chamber 8 and ink supplied in predetermined amounts from the supply ink chamber 9 or 10 becomes the target density. Namely, the mixture ratio calculating portion 531 selects an ink amount to be sucked from each ink mixing chamber 8 and one or both of the inks in respective supply ink chambers 9 and 10 and derives supply amount of respective inks to be mixed to form a first mixture ratio data DM1 representative thereof.

On the other hand, the mixture ratio calculating portion 531 selects one or both of the inks in respective supply ink chambers 9 and 10 and derives supply amount of respective inks to be mixed to form a second mixture ratio data DM2 representative thereof in order to maintain the density of the ink in each ink mixing chamber 8 at the target density.

The data output portion 504 supplies a data group DQ including the first mixing ratio data DM1, the second mixing ratio data DM2, the image data DG and other control data to the control logic circuit portion 511 via the interface 507.

The control system portion 506 in the printer 505 is constructed with parallel or serial interface 507 for taking the data group DQ into the printer 505 from the host computer 501, for example, the central processing unit (CPU) 508 for performing arithmetic operation for start-up process of the printer 505, drive control of various motors, head recovery operation, time control and so forth, the control logic circuit portion 511 for controlling the image data conversion process and the printing operation, program ROM storing various control programs to be executed by CPU 508 and DRAM 510 forming the storage means for temporarily storing the image data and the print data to be transferred to the printing head 515.

To CPU 508, a display/operation portion 514, in which a start-up switch for placing the printer 505 in print enabled state (ON LINE), a command switch for commanding varying of ink color, a light emitting diode (LED) for visually indicating printed enabled state of the printer and so on are arranged and EEPROM 519 as a non-volatile storage means which can be read and written electrically, as a storage means for holding information for managing the printing head portion 515.

The control logic circuit portion 511 is constructed with a gate array, for example, which gate array is constructed with an image data processing portion 512 performing density conversion process and binarization process and distributing respective color data per respective printing heads on the basis of the image data DG transferred from the interface, supply operation control portion 513A deriving respective ink supply amounts to be actually supplied before and during printing operation on the basis of the first mixture ratio data DM1 and the second mixture ratio data DM2 and performing drive control of the energy generating elements 3 and 4 and opening and closing control of the control valves 14 and 15 on the basis of the obtained data, printing operation control portion 513B for performing printing operation control of the printing head portion 515 at a predetermined ejection timing on the basis of respective data from the image data processing portion 512, the first mixture ratio data DM1 and a synchronization pulse signal Sep representative of motion amount of the carriage HC from the encoder 516 provided in the carriage HC, suction operation control portion 532 deriving a discharge amount of the ink in each ink mixing chamber 8 on the basis of the first mixture ratio data DM1 and performing operation of the pump unit of the head recovery portion 521 depending upon the discharge amount, and memory portion 513M for storing data derived by the supply operation control portion 513A and the suction operation control portion 532.

Upon varying the density of the ink in each ink mixing chamber 8 in the printing head portion 515 by the control logic circuit portion 511 on the basis of the varying command signal of the ink from the display/operation portion 514, since similar control is performed respectively, varying of density of one of ink in the ink mixing chamber 8 will be explained.

Before printing operation, if the density of the residual ink in the ink mixing chamber 8 is 50%, for example, when the ink density in the ink mixing chamber 8 is varied into 25%, the target density setting portion 530 of the host computer 501 sets 25% of the ink density as the target density of relatively high use frequency for the density of the ink in each ink mixing chamber 8 with reference to the ink density data on the basis of the image data for one scan or one piece of paper Pa from the memory portion 529.

The mixture ratio calculating portion 531 obtains the mixture ratio (1:1) to achieve 25% of the target density of the ink to be generated before printing operation, by mixing the predetermined amount of the residual ink in each ink mixing chamber 8 and the ink supplied in the predetermined amount from the supply ink chamber 10. Namely, the mixture ratio calculating portion 531 sets the ink amount to be sucked and discharged from each ink mixing chamber 8 at 50% and selects to use only reducer ink in the supply ink chamber 10 to form the first mixture ratio data DM1 representative thereof.

On the other hand, during printing operation, the mixture ratio calculating portion 531 selects both of the supply ink chambers 9 and 10, derives a ratio of the supply amounts of respective inks to be mixed, e.g. mixture ratio (1:3), and forms and transmits the second mixture ratio DM2 representative thereof in order to maintain the density of the ink in each ink mixing chamber 8 at the target density set forth above.

Next, the suction operation control portion 532 of the control logic circuit portion 511 derives suction amount in the pump unit of the suction portion 523 on the basis of the first mixture ratio data DM1 before printing operation. The suction operation control portion 532 forms a control signal Ck depending upon the obtained suction amount to supply to the motor driver 528 for driving respective drive motor for recovery operation. Upon this time, the printing operation control portion 513B forms a control signal Cr to supply to the motor driver 526 for moving the carriage HC to the home position. Accordingly, the printing head 100 is arranged in opposition to the cap 401.

By this, at first, the pressurizing rollers 205 and 305 are moved to X position. Then, by a lifting mechanism, the cap 101 is urged onto the printing head 100 to establish sealing contact. At this time, all of the control valves 14 and 15 in the printing head 100 are placed in closed position.

Then, by fixing only pressurizing roller 305 at the X position, the suction space 104*b* is communicated with the atmosphere via the tube 105*b*. Then, only guide roller 203 is rotated in the direction of arrow a to stop at an M position (an intermediate value between the Y position and the Z position) corresponding to the suction amount, as shown in FIG. 4B. At this time, the cap 401 is released from the printing head 100 by means of the lifting mechanism. During a period where the pressurizing roller 205 is moved from the Y position to the M position, the suction space 104*a* becomes negative pressure to suck the ink in amount of 50% of volume of each ink mixing chamber 8 from the ejection openings 11. On the other hand, air is introduced through the ejection openings 22. Thereafter, the pressurizing roller 205 is moved from the M position to the Z position.

Subsequently, the supply control operation control portion 513A in the control logic circuit portion 511 forms drive control pulse signals Cp and Cv for operating the energy generating element 4 and the control valve 15 depending upon the supply amount for supplying the predetermined amount of the reducer ink from the supply ink chamber 10 on the basis of the first mixture ratio data DM1, and then supplies those drive control pulse signals to the head driver 525. By this, the predetermined amount of the reducer ink is introduced into the ink mixing chamber 8 from the supply ink chamber 10 to generate the ink of the density of 25%.

Thereafter, the printing operation control portion 513B forms a printing control pulse signal Cpb on the basis of the image data DG in synchronism with the ejection timing signal based on the synchronization signal Sep from the encoder 516 in order to operate the ejection energy generating elements 2. Then, the printing control pulse signal Cpb is supplied to the head driver 525. At this time, the printing operation control portion 513B forms a control signal Cr for moving the carriage HC to a print start position to supply to the motor driver 526. On the other hand, the printing operation control portion 513B forms and supplies a control signal Ch for feeding the paper Pa in a predetermined amount to the motor driver 527. Accordingly, by driving the feeding motor 518, the paper Pa is intermittently fed depending upon printing operation in the direction of arrow shown in FIG. 3.

On the other hand, upon initiation of printing operation, the supply operation control portion 513A supplies drive control pulse signals Cp and Cv which differentiate number of pulses per predetermined period at a predetermined ratio in the drive control pulse signals to be respectively supplied to the energy generating elements 3 and 4 and the control valves 14 and 15 corresponding to the mixture ratio (1:3) on the basis of the second mixture ratio data DM2. Accordingly, respective inks in the supply ink chambers 9 and 10 are fed into the ink mixing chamber 8 with a predetermined ratio. By this, even during printing operation, the density of the ink in the ink mixing chamber 8 is maintained at 25%.

Furthermore, the ink density data stored in the foregoing embodiment represents respective ink densities capable of reproducing gradation of respective image data in the form of a map with corresponding to respective image data, so that when the image data exceeds the density range, it may become impossible that optimal image can be reproduced on the paper Pa.

Therefore, in another embodiment of the ink-jet printing apparatus according to the present invention, if the target density setting portion 530 makes judgment that the ink density corresponding to the formed image data is not mapped, the target density setting portion 530 sets an ink density lighter than the ink density corresponding to the image data as a target density. At this time, the target density setting portion 530 feeds data of the target density together with data indicative of necessity of scan for a plurality of times for the same printing region. Relationship among the predetermined ink density, number of times of scan and the image data is determined by data preliminarily derived from experiments.

The mixture ratio calculating portion 531 forms the first mixture ratio data DM1 and the second mixture ratio data DM2 on the basis of the target density set by the target density setting portion 530.

The suction operation control portion 532 of the control logic circuit portion 511 derives the suction amount in the pump unit of the suction portion 523 based on the first mixture ratio data DM1 before printing operation. The suction operation control portion 532 forms the control signal Ck depending upon the derived suction amount to supply to the motor driver 528 which drives respective drive motors for recovery operation.

On the other hand, the supply operation control portion 513A in the control logic circuit portion 511 forms the drive control pulse signals Cp and Cv for operating the energy generating elements 4 and 3 and the control valves 14 and 15 for a predetermined period depending upon the supply amount for supplying the ink from the supply ink chamber 9 or 10 on the basis of the first mixture ratio data DM1 to supply to the head driver 525.

The printing operation control portion 513B forms the printing control pulse signal Cpb based on the image data DG in synchronism with the ejection timing signal based on the synchronization signal Sep from the encoder 516 for operating the ejection energy generating elements 2. At this time, the printing operation control portion 513B operates the printing head and the carriage HC to perform operation for reciprocation predetermined times, e.g. twice, for the sane printing region when the printing head portion 515 reaches the image forming position where the ink is used on the basis of data indicative of necessity of scanning for a plurality of times for the same printing region where the image is formed in the ink density from the target density setting portion 530.

On the other hand, upon initiation of printing operation, the supply operation control portion 513A supplies the drive control pulse signals Cp and Cv differentiated the number of pulses at predetermined ratio per a predetermined period in the drive control pulse signals respectively supplied to the energy generating elements 3 and 4 and the control valves 14 and 15 corresponding to the mixture ratio on the basis of the second mixture ratio data DM2, in the similar manner to the foregoing embodiment. By performing such printing control, range of the ink density can be expanded to permit printing at more precise gradation level.

While the ink density in the printing head portion 515 of respective ink color selected upon printing, can be varied at every one page of printing, it is also possible to vary the ink density per each scan. In this case, the target density setting portion 530 and the mixture ratio calculating portion 531 in the printer control portion (printer driver) 502 may determine the target density and the mixture ratio to be used for printing with respect to each ink color of black, magenta, cyan and yellow per one scan of the printing data.

The image data output portion 504 transfers respective data to the printer 505 at the same time of feeding of the image data for one scan. In the printer 505, on the basis of the ink density data per one scan, the printing head 515 and the head recovery portion 521 are controlled to vary the ink density in the printing head 515 for each ink color. By varying the ink density per one scan, printing with high fidelity can be performed based on the image data.

On the other hand, upon performing printing with varying the ink density, in order to reduce the ink discharge amount from the ink mixing chamber 8 as much as possible and vary the ink density by efficiently use the ink from the ink mixing chamber 8, it may be possible to initiate printing from a high density portion in an image formed on paper Pa, and then perform printing with gradually varying the density to a low density portion. By performing such printing control, range of the ink density to be selected can be expanded to permit printing at more precise gradation level.

(Other Embodiments)

While the major part of the present invention has been described, other embodiments and modifications for implementing the present invention will be explained hereinafter. It should be noted that the following embodiments will be applicable to respective of the foregoing embodiments unless specified otherwise.

(Shape of Mixing Liquid Chamber)

Figure 15A:
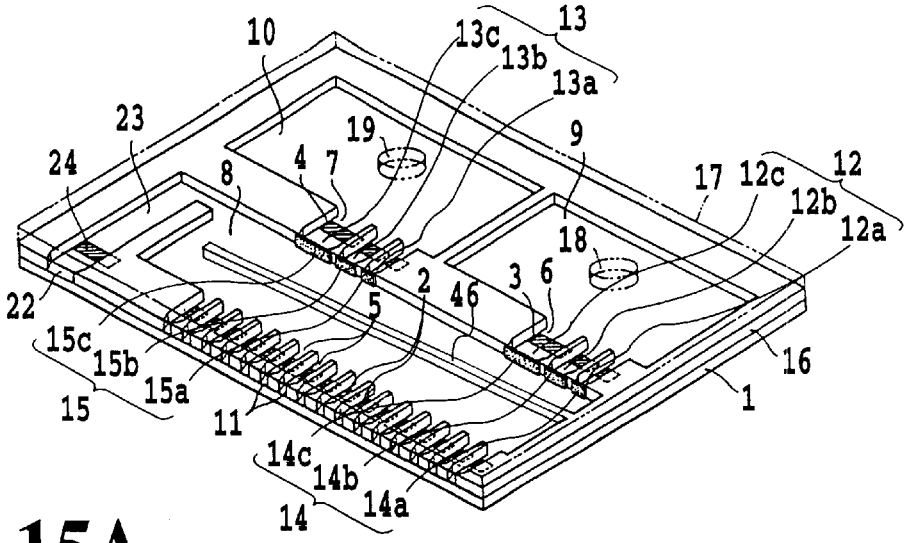
FIGS. 15A, 15B and 15C are exploded perspective views showing major parts respectively for explaining modifications of the ink-jet printing head according to the present invention.
Figure 15B:
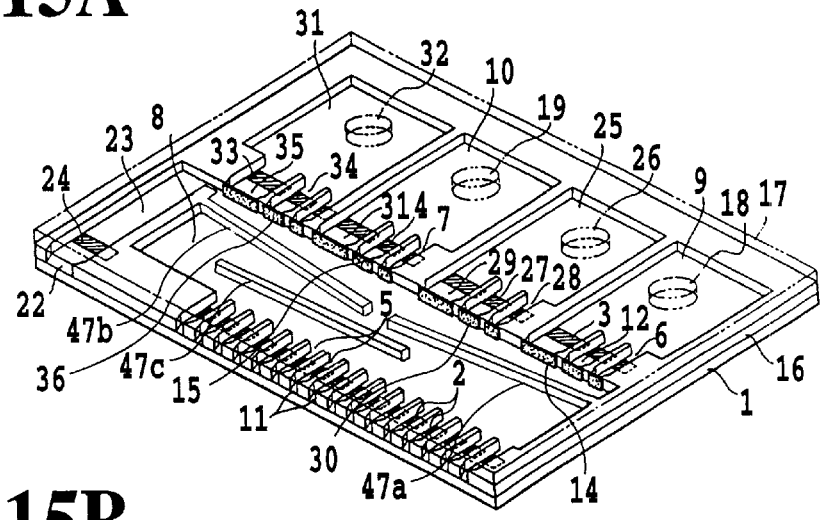
Figure 15C:
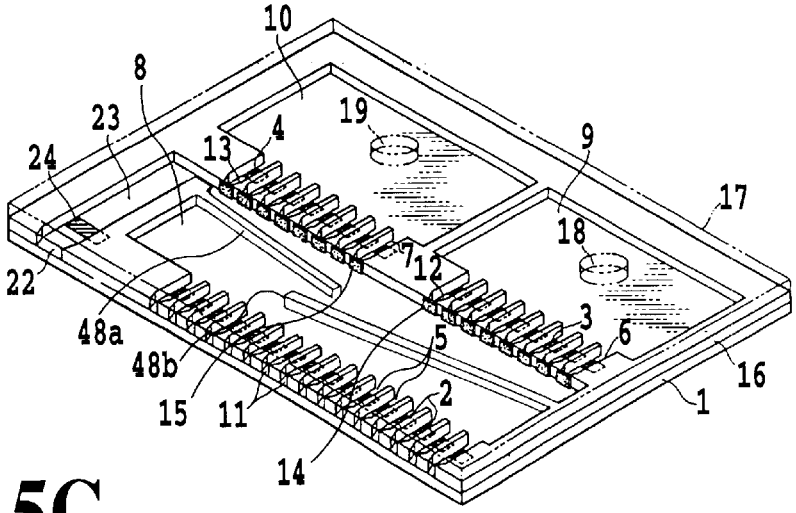

FIGS. 15A to 15C show modifications of the first to third embodiments of the present invention, respectively. In these modifications, partitioning walls 46, 47 and 48 are provided in the mixing liquid chamber 8, respectively. These partitioning walls are intended to serve for uniformly mixing a plurality of kinds of inks of different densities or containing different coloring agents, supplied through the control valves. In these modifications, the partitioning wall as the ink mixing means is effective for certainly mixing of the ink upon ejection in comparison with respective of foregoing embodiments to suppress fluctuation of density of the ink or coloring agent of the ink to be ejected. The shape of the partitioning wall is not limited to respective of the shown embodiments, various combination may be possible. Even for the arrangement of the partitioning wall, by the flow of the ink within the mixing liquid chamber 8, any shape which can perform mixing of the ink, may be taken. More particularly, it is a preferred construction that allows ink to flow along the partitioning wall as long as possible.

(Waste Ink Receptacle Portion)

Figure 16A:
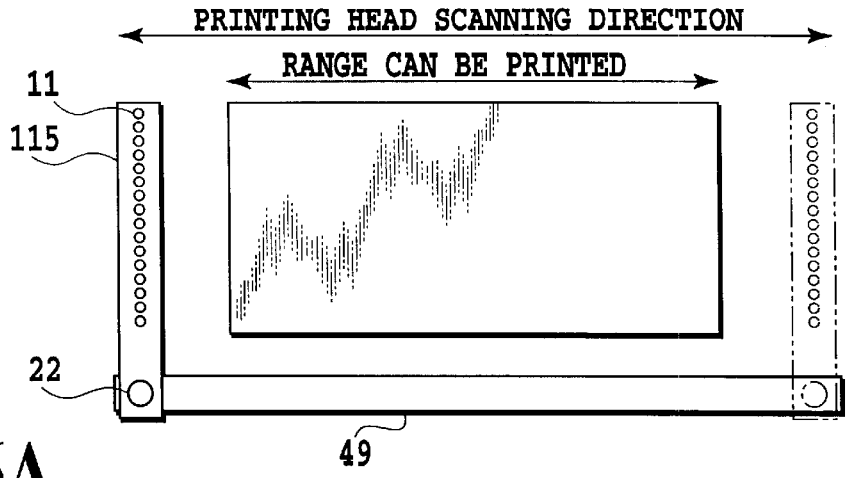
FIGS. 16A, 16B and 16C are diagrammatic explanatory illustrations for explaining arrangement of a waste ink absorbing body of the ink-jet printing apparatus according to the present invention.
Figure 16B:
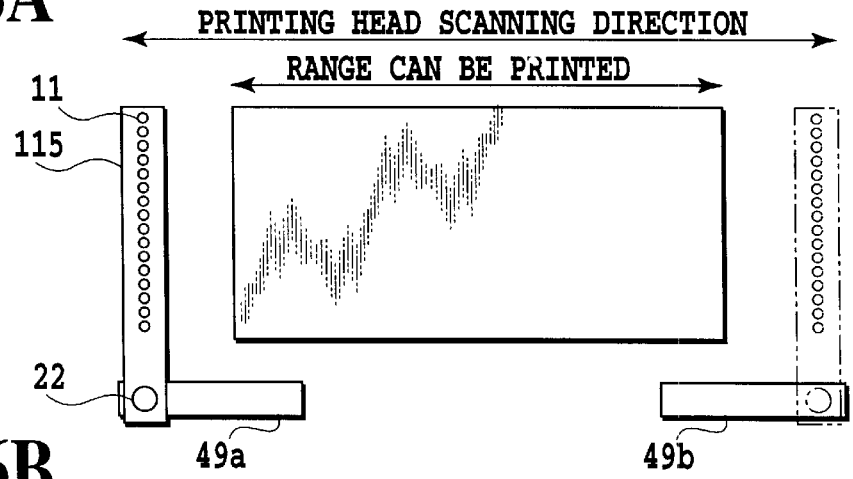
Figure 16C:
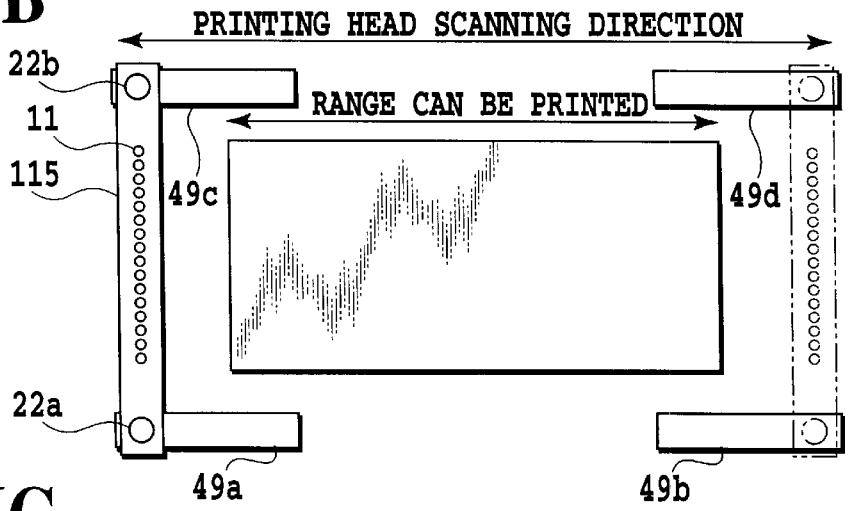

FIGS. 16A to 16C are explanatory illustrations for explaining a waste ink receptacle portion preferably applicable to the ink-jet printing apparatus according to the present invention.

In the respective of foregoing embodiments, waste ink absorbing body 49 for absorbing the waste ink from the ejection openings 22 is provided in a carriage scanning direction (scanning direction of the printing head). The waste ink absorbing body is formed of a porous material, such as foamed urethane, for example. In the embodiment shown in FIG. 16A, at any positions in the motion range of the printing head, the waste ink can be ejected to the waste ink absorbing body.

Accordingly, ejection of the waste ink during movement of the printing head becomes possible. A position of switching the mixture ratio of a plurality of inks is not limited to the position where the recovery pump is provided, as in the former embodiment, so that the mixture ratio of a plurality of inks can be switched during movement. Therefore, the mixture ratio of the ink can be quickly switched.

Particularly, when the mixture ratio of the ink is varied upon scanning the same region for a plurality of times as in the foregoing seventh embodiment, during movement to return to the original position after performing printing in one direction in each scan, inks are supplied from the individual liquid chambers for establishing the ink density for the next scan to eject the waste ink within the mixing liquid chamber to improve throughput in printing operation.

It should be noted that while the waste ink absorbing body 49 is formed to continuously extend in the scanning direction of the printing head in the embodiment shown in FIG.

16A, the waste ink absorbing body is not necessarily continuous single body but can be consisted of a plurality of waste ink absorbing bodies as shown in FIG. 16B. However, in order to permit variation of the mixture ratio of the mixture ink at any arbitrary position s of the printing head, the shape shown in FIG. 16A is preferred.

On the other hand, in the case where the ejection openings 22 are provided at opposite ends of the printing head as shown in FIG. 16C, it is desirable to provide waste ink absorbing bodies 49*a*, 49*b*, 49*c* and 49*d* correspondingly.

(Liquid to be Received)

In respective embodiments set forth above, a liquid stored in the individual liquid chamber is an ink or an achromatic ink for reducing the density of ink. However, it is desirable to store a washing liquid in one of the individual liquid chambers so as to once fill the washing liquid in the common liquid chamber upon varying density and so on of the ink to be ejected, and then to obtain a liquid of the predetermined density by mixing inks, for capability of quickly and certainly exchange inks within the liquid chamber without causing admixing of the color with simple construction.

For example, explanation will be given for the case where the washing liquid is used in the first embodiment. It is assumed that individual liquid chamber 9 is used as a washing liquid chamber and individual liquid chamber 10 is used as an ink chamber. In this case, in order to perform normal printing operation, all of the control valves 14 are closed and all of the control valves 15 are opened to supply the ink in the ink chamber 10 into the liquid chamber 8 and then to be ejected through the ejection openings 11. Upon exchanging the ink in the ink chamber 10 for exchanging of an ink tank (not shown) connected to the ink supply opening 19, for connection of a new ink tank (not shown) storing ink of different color to the ink supply opening 19 and for other reason, the control valves 14 and 15 are opened so as to easily realize exchanging of the ink by performing suction recovery operation. Such exchanging of the inks may also be performed by ejection of the ink separately from normal printing operation, i.e. so-called preparatory ejection, in addition to that performed by suction recovery operation. The preparatory ejection is referred to ink ejecting operation to be performed with directing the ejection opening s of the printing head toward a portion outside of the printing paper, e.g., toward the suction opening of the suction recovery means.

Figure 17:
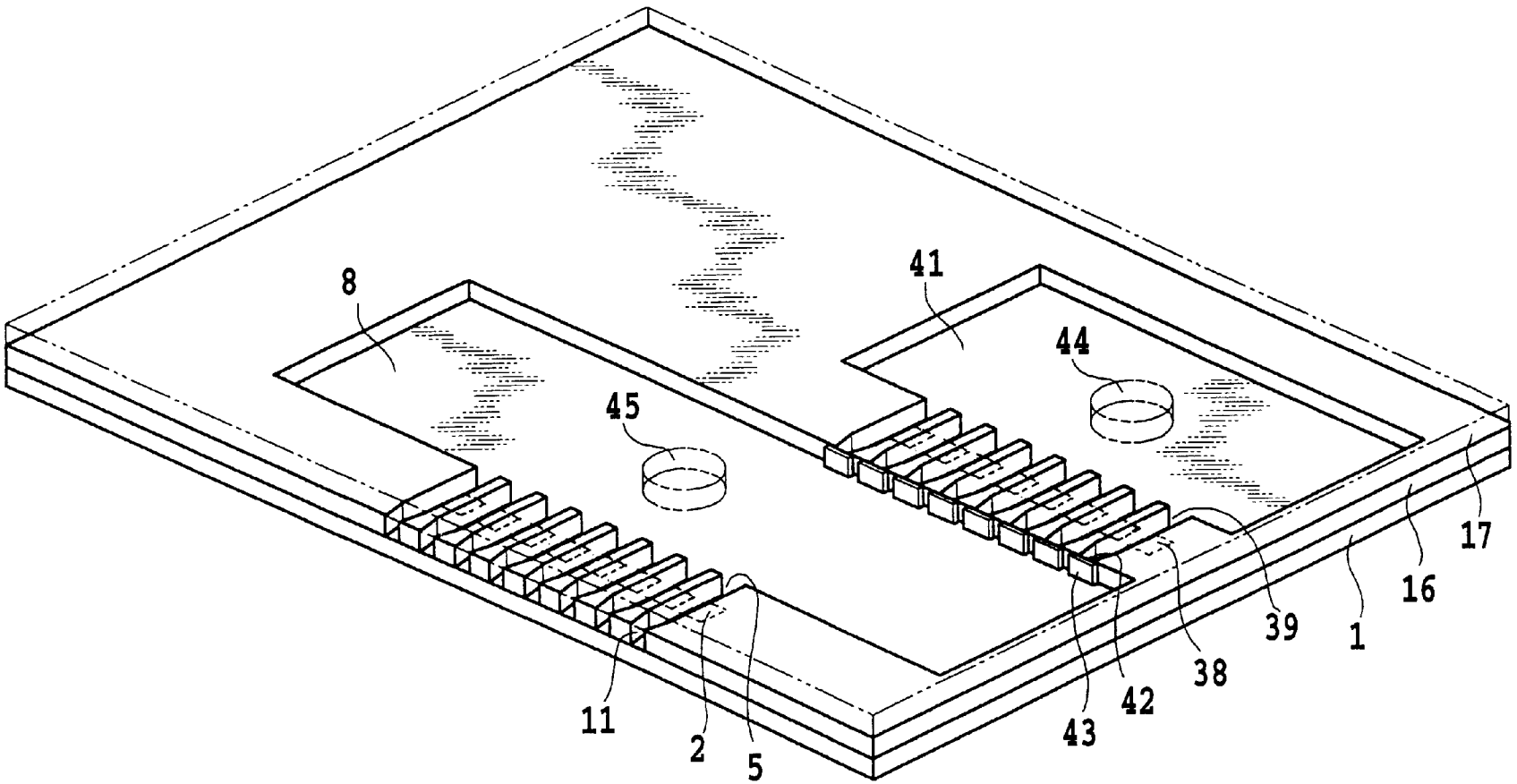
FIG. 17 is an exploded perspective view showing a modification of the ink-jet printing head according to the present invention.

On the other hand, when ink tanks respectively containing different kinds of inks can be set for one ink chamber as set forth above and a plurality of mutually different kinds of inks are ejected by setting these ink tanks, configuration of the printing head is not limited to that illustrated in FIG. 1 but can be a construction as illustrated in FIG. 17.

In FIG. 17, at a predetermined position on the substrate 1, a plurality of thermal energy generating elements 2 serving as the ink ejecting means are provided, and on the rear side of the thermal energy generating elements, a plurality of energy generating elements 38 as a washing liquid moving means are provided. The energy generating element in the shown embodiment may be a piezoelectric element, a piezo element or the like in addition to an electrothermal transducer. The thermal energy generating elements 2 are arranged along one peripheral edge of the substrate 1 with an equal interval and are separated from each other by wall portions of ink passages 5. Front ends of respective ink passages 5 are communicated with a plurality of ejection openings 11 for ejecting ink, respectively. These ejection openings 11 are eight in the shown embodiment. On the other hand, the rear ends of the ink passages 5 are communicated with a common liquid chamber 8 serving as a first liquid chamber.

On the rear side of the common liquid chamber 8, a washing liquid chamber 41 serving as a second liquid chamber for supplying a washing liquid to the common liquid chamber 8. The common liquid chamber 8 and the washing liquid chamber 41 are communicated with a plurality of communication apertures 42. In the upper portion of the washing liquid chamber 41, a washing liquid supply opening 44 for performing supply of the washing liquid to the washing liquid chamber 41 is provided. On the other hand, in the upper portion of the common liquid chamber 8, an ink supply opening 45 for connecting an ink tank (not shown in FIG. 17) for performing ink supply to the common ink chamber is provided.

On the other hand, eight communication apertures 42 are formed in the shown embodiment. These eight communication apertures 42 have the same opening area. For all of the communication apertures 42, control valves 43 having the same dimension are provided. In each communication aperture 42, liquid passages 39 communicated with the communication apertures 42 are provided. In the bottom portion of each liquid passage 39, the energy generating element 38 serving as the foregoing washing liquid moving means is provided. The control valve 43 serves for preventing leakage of the washing liquid from the washing liquid chamber 41 into the common liquid chamber 8 and also serves for preventing surge flow of the washing liquid from the common liquid chamber 8 to the washing liquid chamber 41. Then, the control valve 43 forms the washing liquid supply control means together with the energy generating element 38 arranged within the same liquid passage 39. The energy generating element 38 moves the washing liquid toward the common liquid chamber 8 in synchronism with the control valve 43 upon opening of the control valve 43. It should be noted that, to the energy generating elements 38, electrodes (not shown) for inputting respective drive signals, are connected.

It should be noted that, in the shown embodiment, multi-value printing can be performed by appropriately exchanging ink tanks (not shown in FIG. 17) to be connected to the ink supply opening 45 as required by the user. On the other hand, concerning the washing liquid tank (not shown) to be connected to the washing liquid chamber 41 via the washing liquid supply opening 44, it may not be exchanged unless all of the washing liquid is consumed.

Figure 18:
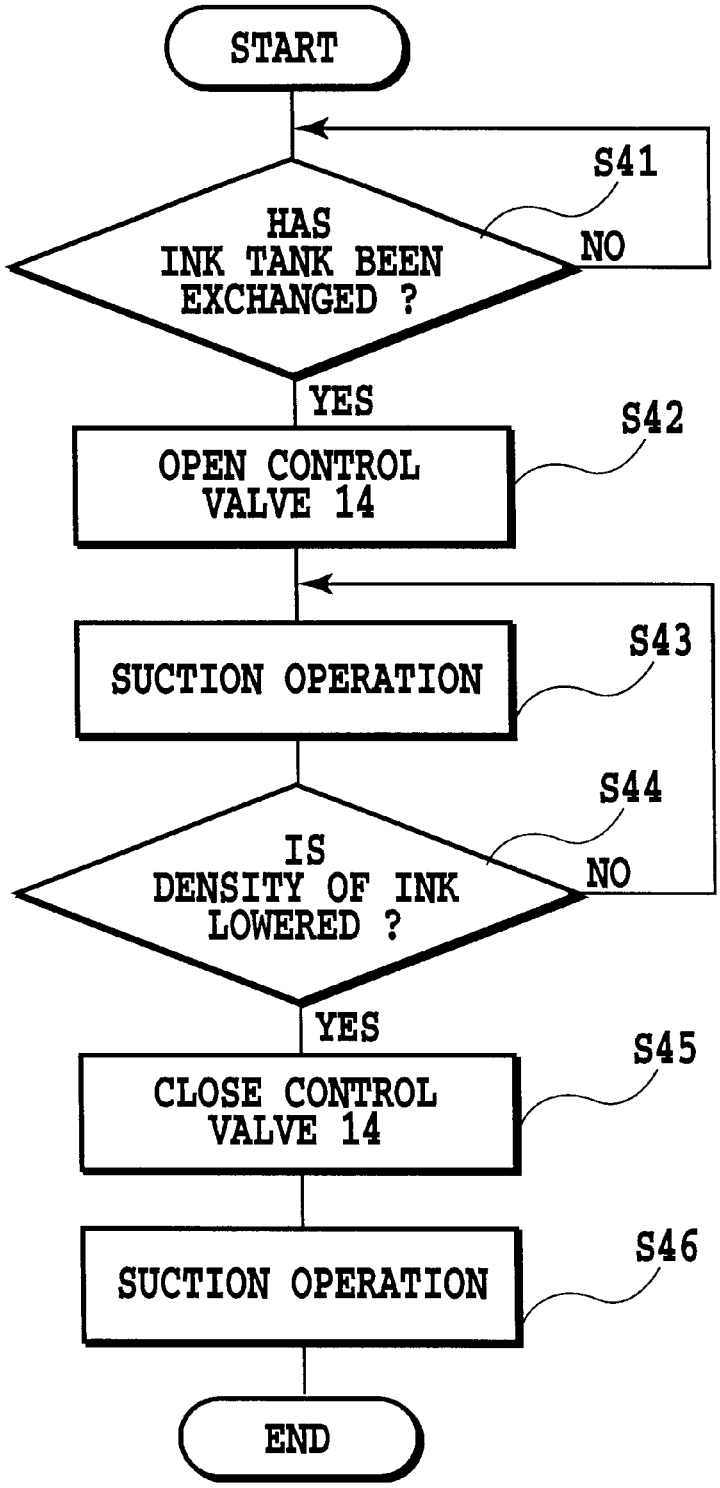
FIG. 18 is a flowchart showing a recovery operation of the printing head shown in FIG. 17.

Next, operation of the shown embodiment will be explained with reference to FIG. 18.

At first, upon performing normal printing, after filling the ink within the common liquid chamber 8, all of the control valves 43 are closed so that the washing liquid may not be supplied into the common chamber 8 from the washing liquid chamber 41. Thereafter, the common liquid chamber 8 is situated to receive only ink supplied through the ink supply opening 45. In this condition, according to the drive signal from not shown CPU, the ejection energy generating elements 2 are driven to eject the ink through the ejection openings 11.

Next, when the ink tank (not shown) connected to the ink supply opening has been exchanged and the new ink tank (not shown) containing the ink of the different color has been connected to the ink supply opening 45 (step S41), all of the control valves 43 are opened (step S42) for permitting supply of the washing liquid from the washing liquid chamber 41 to the common liquid chamber 8 and then suction operation which will be explained later, is repeated for the ejection openings 11 (step S43) to fill the washing liquid within the common liquid chamber 8 in place of the ink. By this, the residual ink in the common liquid chamber 8 before exchanging can be reduced to the extent not affecting for the next printing. At this time, by using the energy generating elements 38, the washing liquid can be moved smoothly to shorten a washing period. Subsequently, once the ink density in the common liquid chamber 8 is lowered to the density not affecting for the next printing (step S44), all of the control valves 43 are closed (step S45). Then, after shutting off inflow of the washing liquid from the washing liquid chamber 41, suction operation is performed again and thereafter the ink after exchanging is filled in the common liquid chamber 8 via the ink supply opening 45. Then, a sequence of operation goes end.

(Ejection Opening for Recovery)

The ejection opening 22 provided in the foregoing embodiments serves as an atmospheric air suction opening and also as a discharge opening for discharging the ink. Focusing this point, the ejection opening 22 may be applicable in a configuration illustrated in FIG. 19.

Figure 19:
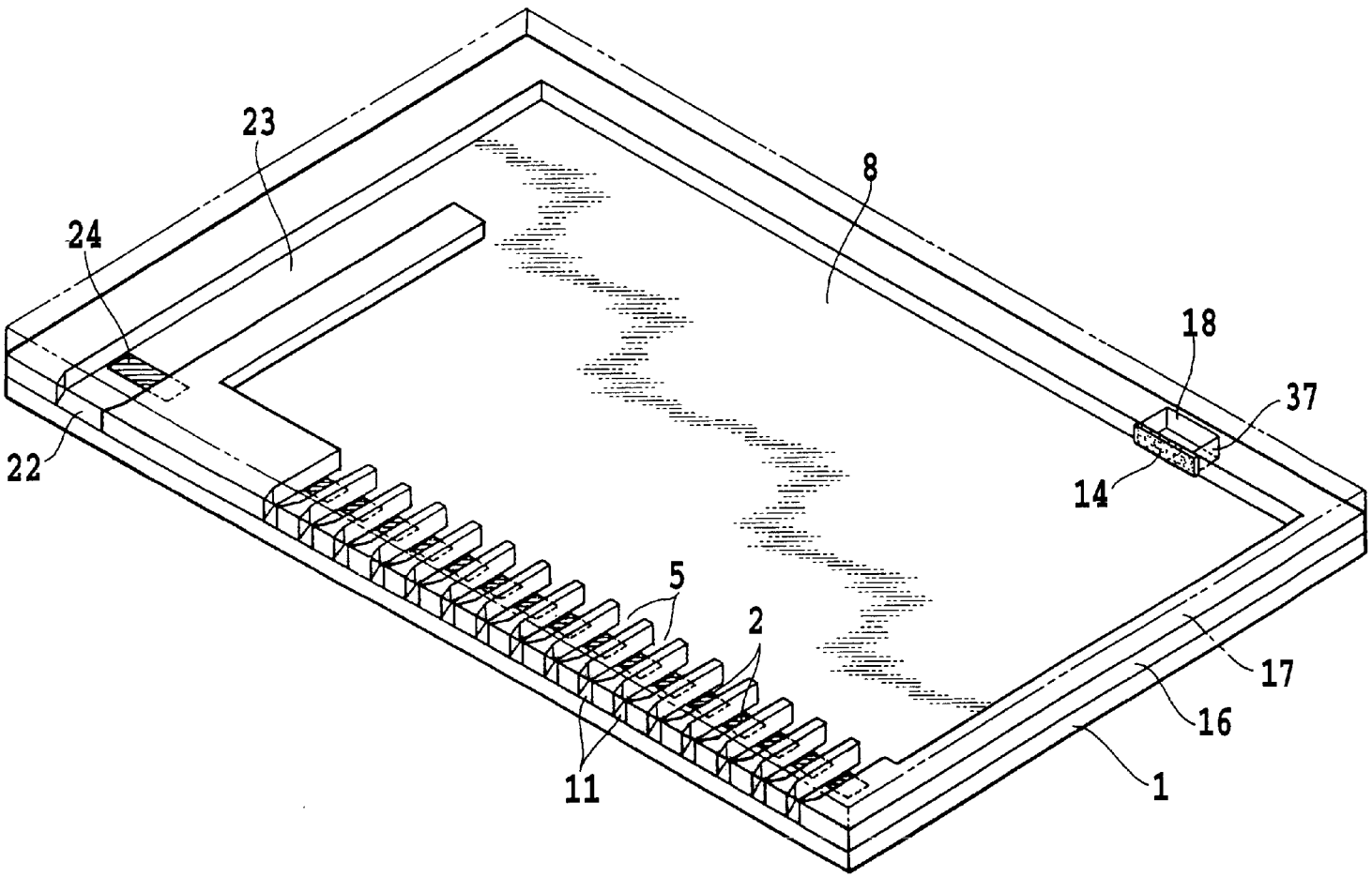
FIG. 19 is an exploded perspective view showing a modification of the ink-jet printing head according to the present invention.

A printing head shown in FIG. 19 is constructed without providing a substantially large rear liquid chamber on the rear side of one common liquid chamber 8, and instead, with forming an ink supply portion by an ink supply opening 18 and a narrow small chamber 37 corresponding to the ink supply opening 18. Between the ink supply portion and the common liquid chamber 8, a control valve 14 separating therebetween and controlling the ink supply amount, is provided. With such a construction, in a condition where the control valve 14 is held open, the ink suction operation is performed through both of the ink ejection openings 11 and the ejection opening 22 serving as an atmosphere communication opening to remove blocking in all of the ink passages 5 and the ink ejection openings 11 or to fill the common liquid chamber 8 with a fresh ink from the ink supply opening 18. On the other hand, in a condition where the control valve 14 is closed, by performing ink suction operation from the ink ejection openings 11 with using the ejection opening 22 as an atmosphere communication opening as an atmospheric air inlet, the common liquid chamber 8 can be made empty.

On the other hand, while the cap member as the recovery member is formed in an integral construction and two systems of tubes and pumps are arranged as a suction means for ink ejection openings and a suction means for atmosphere communication opening in the first embodiment, the present invention should not be limited to the shown construction. For example, the cap means for ink ejection openings and the cap means for atmosphere communication opening can be formed separately. By forming these as separate construction, two suction operation s can be implemented at mutually independent timing.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As set forth above, according to the present invention, by providing one mixing liquid chamber communicated with a plurality of ejection openings and a plurality of ink passages and providing control means for controlling ink supply to the mixing liquid chamber, it becomes possible to vary density while the size of the ink droplet is maintained constant so as to realize printing with higher printing quality. On the other hand, by adjusting the ink density in the mixing liquid chamber, ink with different density can be ejected without using a plurality of printing heads and preliminarily prepared inks with different densities. For example, a colored ink is filled in one of two individual liquid chambers communicated with the mixing liquid chamber, and achromatic ink is filled in the other individual chamber to obtain an ink of the density of half of the colored ink by mixing the colored ink and the achromatic ink within the mixing liquid chamber in a proportion of 1:1. On the other hand, by using only achromatic ink, the printing apparatus can be maintained in a stored condition for a long period of time without causing fear of plugging or the like. Furthermore, it is also possible to fill the ink of cyan color in one of the individual liquid chambers and to fill the ink of yellow color in the other individual liquid chamber so as to obtain the ink of green color by mixing both inks in a proportion of 1:1 within the mixing liquid chamber. Namely, preparation of secondary color and variation of density of the secondary color can be performed. On the other hand, an ink amount to be ejected may be small because of one droplet ejection per one pixel, kink of printing paper which has been caused conventionally due to ejection of plurality of droplets per one pixel, can be reduced. Also, speeding up of fixing can be achieved. Furthermore, range of the printing paper applicable for the present invention can be widened.

On the other hand, by providing the intermediate liquid chamber for storing the mixture ink between the mixing liquid chamber and the ejection liquid chamber, ink consuming amount upon switching of inks can be restricted to only the ink amount in the ejection liquid chamber so that the ink consuming amount associating with switching of inks can be lowered and the switching period can be shortened. On the other hand, by providing a plurality of the intermediate liquid chamber s to establish a plurality of passages from the mixing liquid chamber to the ejection liquid chamber, it is possible to perform switching of passages with selecting the intermediate liquid chambers so that the mixture ratio of the ink in the intermediate liquid chambers can be maintained always same. Consequently, after switching, without performing mixing operation again, the ink having the same mixture ratio can be ejected.

On the other hand, according to the present invention, since kind of ink to be supplied into the ink chamber is selected on the basis of the image data, density can be varied with maintaining the size of the ink droplet constant to permit printing of the image of higher quality. On the other hand, in order to eject ink of different density, it becomes unnecessary to provide a plurality of printing heads. Also, by varying the ink density and by overlap printing for a plurality of times, the density level of the image data transferred from the host computer or the like can be reproduced with high fidelity. Furthermore, by providing the cap which can be capped on the ink ejection openings, ejection failure by plugging of the ink can be prevented to eliminate necessity of maintenance.

On the other hand, with the ink-jet printing apparatus according to the present invention, when the ink mixing chamber is provided and the ink within the ink mixing chamber is ejected to perform printing the image on the printing surface of the printing medium by the printing portion, the mixture ratio calculating portion calculates a mixture ratio of a residual ink in the ink mixing chamber of the printing portion and an ink of predetermined density supplied to the ink mixing chamber so that the ink density of the ink mixing chamber of the printing portion becomes the target ink density on the basis of the target ink density data set by the target density setting portion. Then, the ink density within the ink mixing chamber is adjusted on the basis of the data indicative of the mixture ratio from the mixture ratio calculating portion. Accordingly, employment of multiple nozzles and down sizing of the apparatus can be easily achieved by employing the ink-jet printing head which can eject ink having different ink density from the same ejection openings without varying size of the ink droplet. Furthermore, recording, such as printing, with more precise gradation expression can be realized.

On the other hand, since the target density setting portion sets the target ink density of the ink density having relatively high use frequency on the basis of the image data representative of the image to be printed on the printing surface of the printing medium by the printing portion, the density level of the image data transferred from the host computer or the like can be reproduced with higher fidelity.

Furthermore, since the mixture ratio calculating portion calculates the mixture ratio of a residual ink in the ink mixing chamber of the printing portion and an ink of predetermined density supplied to the ink mixing chamber so that the ink density of the ink mixing chamber of the printing portion becomes the target ink density on the basis of the data of the target ink density, us age efficiency of the ink can be improved without wastefully discharging the ink. Fluctuation of the density of the ink droplets ejected from the ejection openings can be avoided.

Moreover, by providing the atmosphere communication opening in addition to the ink ejection openings in the common liquid chamber of the printing head, and using it as the ink suction opening simultaneously with the ink ejection openings, blocking in all of the ink passages can be removed, or, in the alternative, the common liquid chamber can be filled with the fresh ink from the ink supply portion. In comparison with suction operation only from the ink ejection openings as in the prior art, suction operation can be advantageously performed quickly and certainly. Furthermore, by using the atmosphere communication opening as an atmospheric air suction opening and performing ink suction from the ink ejection openings, it becomes possible to make the common liquid chamber empty. Here, admixing of the colors with other kind of the ink can be prevented in the ink tank exchangeable type printing head.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet printing apparatus comprising:

an ink-jet printing head including:

a plurality of ejection openings arranged in a row for ejecting ink;

a plurality of ink passages respectively communicating with said plurality of ejection openings;

ink ejection means provided in said plurality of ink passages;

a common liquid chamber connected to said plurality of ink passages in common;

an ink supply portion for supplying the ink to said common liquid chamber;

control means, provided between said ink supply portion and said common liquid chamber, for controlling a supply amount of the ink supplied from said ink supply portion;

an atmosphere communication opening, arranged on an extension of the row of said ejection openings, for communicating said common liquid chamber with outside;

first capping means for placing said ejection openings within a first sealably enclosed space;

first suction means for reducing a pressure within said enclosed space between said first capping means and said printing head;

second capping means for placing said atmosphere communication opening within a second sealably enclosed space;

second suction means for reducing a pressure within said enclosed space between said second capping means and said printing head; and wherein said first suction means and said second suction means are driven at respectively independent timing.

2. An ink-jet printing apparatus as claimed in claim 1, which further comprises a carriage for moving said printing head for scanning, and a waste ink absorbing body extending along a scanning direction of said printing head at a position overlapping with a range in which printing by said printing head on said printing medium can be performed, for receiving waste ink discharged from said printing head.

3. An ink-jet printing apparatus as claimed in claim 2, wherein said printing head discharges the waste ink toward said waste ink absorbing body during movement.

* * * * *

UNITED STATES PATENT AND TRADEMARK OFFICE

CERTIFICATE OF CORRECTION

PATENT NO. : 6,557,984 B2
DATED : May 6, 2003
INVENTOR(S) : Sohei Tanaka et al.

It is certified that error appears in the above-identified patent and that said Letters Patent is Drawings,
Sheet 8, FIG. 6, “ESTABLISDHING” should read -- ESTABLISHING --.

Column 3,
Line 65, “associating” should read -- associated --.

Column 4,
Line 12, “provided.” should read -- be provided. --; and
Line 16, “here” should read -- there --.

Column 5,
Line 61, “top” should read -- to --; and
Line 65, “ink- jet” should read -- ink-jet --.

Column 6,
Line 1, “opening s” should read -- openings --; and
Line 53, “valve s.” should read -- valves. --.

Column 7,
Lines 21 and 29, “an” should read -- a --; and
Line 65, “shown” should read -- showing --.

Column 8,
Line 6, “operation” should read -- operations --.

Column 9,
Line 20, “with” should read -- from --.

Column 11,
Line 15, “numeral s” should read -- numerals --.

Column 12,
Line 11, “arrow 2.” should read -- arrow b. --.

Column 13,
Line 36, “varied” should read -- varied as to --; and
Line 57, “chamber” should read -- chamber 10 --.

UNITED STATES PATENT AND TRADEMARK OFFICE

CERTIFICATE OF CORRECTION

PATENT NO. : 6,557,984 B2
DATED : May 6, 2003
INVENTOR(S) : Sohei Tanaka et al.

It is certified that error appears in the above-identified patent and that said Letters Patent is hereby corrected as shown below:

Column 14,
Lines 28 and 34, “an” should read -- a --.

Column 21,
Line 13, “as” (first occurrence) should read -- is --; and
Line 40, “diver” should read -- driver --.

Column 24,
Line 55, delete “with”.

Column 25,
Line 32, “sane” should read -- same --.

Column 26,
Line 2, “use” should read -- using --; and
Line 47, “positions” should read -- position --.

Column 27,
Line 5, “position s” should read -- position --; and
Line 42, “opening s” should read -- openings --.

Column 29,
Line 51, “operation s” should read -- operations --.

Column 30
Line 40, “consists” should read -- consist --.

Column 32,
Line 10, “associating” should read -- associated --; and
Line 13, “chamber s” should read -- chambers --.

Column 33,
Line 2, “us age” should read -- usage --.

UNITED STATES PATENT AND TRADEMARK OFFICE

CERTIFICATE OF CORRECTION

PATENT NO. : 6,557,984 B2
DATED : May 6, 2003
INVENTOR(S) : Sohei Tanaka et al.

It is certified that error appears in the above-identified patent and that said Letters Patent is hereby corrected as shown below:

Column 34,
Line 26, “timing.” should read -- timings. --.

Signed and Sealed this

Sixth Day of January, 2004

JAMES E. ROGAN
*Director of the United States Patent and Trademark Office*